US006705473B1

(12) United States Patent
Schlesinger

(10) Patent No.: US 6,705,473 B1
(45) Date of Patent: Mar. 16, 2004

(54) PAMPHLET DISPLAY/DISPENSER

(76) Inventor: Peter Richard Schlesinger, 8 Puna Street, Orakei, Auckland (NZ)

( * ) Notice: Subject to any disclaimer, the term of this patent is extended or adjusted under 35 U.S.C. 154(b) by 0 days.

(21) Appl. No.: 09/719,569

(22) PCT Filed: Jun. 30, 1999

(86) PCT No.: PCT/NZ99/00098

§ 371 (c)(1),
(2), (4) Date: Mar. 27, 2001

(87) PCT Pub. No.: WO00/00945

PCT Pub. Date: Jan. 6, 2000

(30) Foreign Application Priority Data

Jun. 30, 1998 (NZ) ..... 330842

(51) Int. Cl.[7] ..... B42F 7/00
(52) U.S. Cl. ..... 211/50; 211/55
(58) Field of Search ..... 211/50, 55; D6/475; 16/269

(56) References Cited

U.S. PATENT DOCUMENTS

| | | | | | |
|---|---|---|---|---|---|
| 816,904 | A | * | 4/1906 | Early | 211/50 |
| 2,645,152 | A | * | 7/1953 | Martin | 211/50 |
| 4,253,260 | A | * | 3/1981 | Maza et al. | 16/269 |
| 5,085,328 | A | | 2/1992 | Evenson | 211/55 |
| 5,165,554 | A | | 11/1992 | Schlesinger | 211/51 |
| 5,184,737 | A | * | 2/1993 | Hardy | 211/55 |
| 5,263,578 | A | * | 11/1993 | Narvey | 211/55 |
| 5,477,967 | A | * | 12/1995 | Voorhees et al. | 211/55 |
| 5,575,396 | A | * | 11/1996 | Smed | 211/55 |
| 5,727,696 | A | * | 3/1998 | Valiulis | 211/51 |
| 5,992,652 | A | * | 11/1999 | Springs | 211/59.3 |
| D423,824 | S | * | 5/2000 | Schlesinger | D6/475 |

FOREIGN PATENT DOCUMENTS

AU 66310/86 6/1987

OTHER PUBLICATIONS

Patent Abstracts of Japan, 09050237A, Feb. 18, 1997, "Housing Body for Display Pamphlet or the Like", Katsumi.

* cited by examiner

*Primary Examiner*—Daniel P. Stodola
*Assistant Examiner*—Erica B. Harris
(74) *Attorney, Agent, or Firm*—Jacobson Holman PLLC

(57) ABSTRACT

A pamphlet display/dispenser, which can have interior height adjustment and/or dividers to accommodate all paper and pamphlet sizes, has a pamphlet container unit with a cavity to contain pamphlets biased to lie against the front wall to facilitate retrieval of the rearmost pamphlet and a front window, which can contain a further pamphlet or other material. A hinge enables the dispenser to open out into a walk-forward "open" mode to further facilitate retrieval of the rearmost pamphlet and in which position the pamphlet display/dispenser can be self-supporting, or the dispenser can be "closed" as a wall mounted unit.

23 Claims, 20 Drawing Sheets

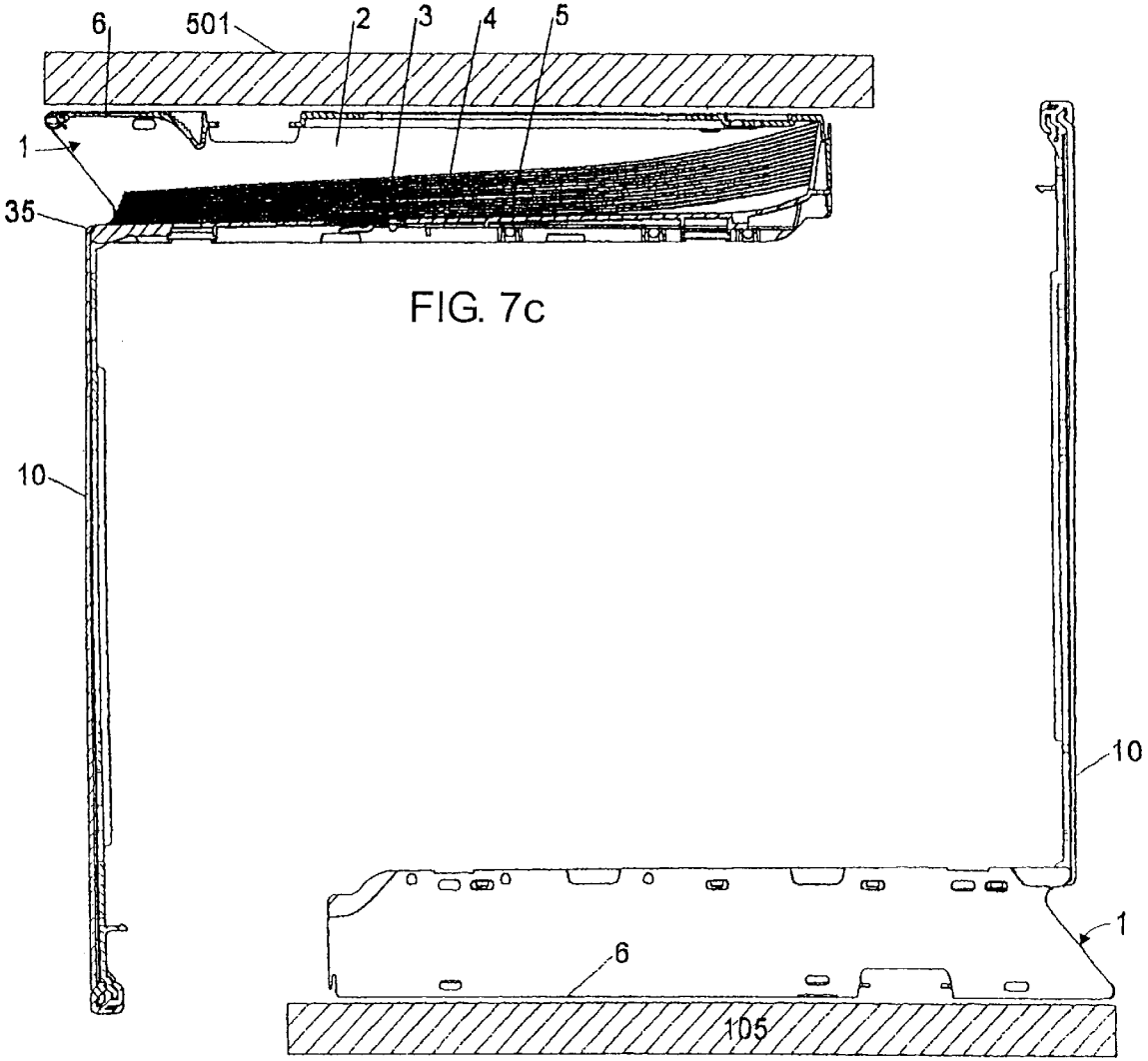
FIG. 7c
FIG. 7d
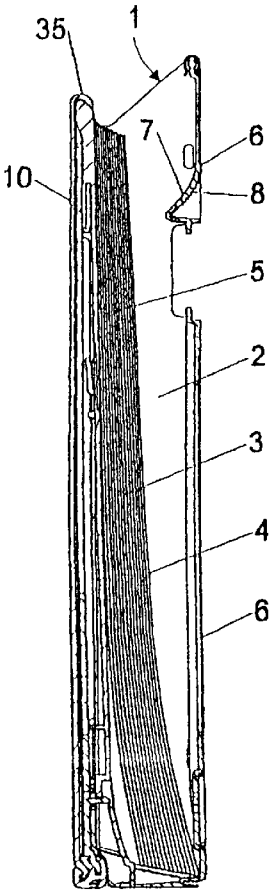
FIG. 7b

EMPTY
1
2
5
6
10
50
51
52
53
54
60

110
115
111
116

10
1
C
100
104
110

117
106
107
1
100
104
116

10
6
1
B
1
10
6

110
116
107
6
1
6
116
107
110

6
1
116
107

6
6
110
1
A
1

PAMPHLET DISPLAY/DISPENSER

The present invention relates to improvements in and relating to a pamphlet display/dispenser.

In my earlier New Zealand patent 230890/233611 is described and claimed a storage rack that enables both the storage and display of papers and pamphlets and most importantly is so designed as to bias the stack of papers or pamphlets towards the front wall of the storage to facilitate the withdrawal of the rear most pamphlet or paper. That biasing is preferably achieved by the base of the storage rack being inclined upwardly from a lower edge of the rear wall towards the front wall.

The contents of my New Zealand Patent Specification 230890/234611 are incorporated herein in their entirety where appropriate.

OBJECTS OF THE INVENTION

It is an object of the present invention to provide a pamphlet display/dispenser, which is a further development of my original storage rack to provide additional benefits and which will at least provide the public with a useful choice.

Further objects of this invention will become apparent from the description.

BRIEF SUMMARY OF THE INVENTION

According to one aspect of the present invention, there is thus provided a pamphlet display/dispenser having a front wall spaced from a rear wall by a pair of side walls to define a cavity, an open top, a base interconnecting lower ends of the front and rear wall, a front member provided for said front wall and adapted to pivot relative thereto to facilitate removal of a rear most pamphlet and so that a lower portion thereof can be spaced apart from the said front wall to act as a support.

Preferably, vertically adjustable biasing means are provided so as to bias pamphlets, contained within the space, towards said front wall and further facilitate the removal of the rear most pamphlet.

Preferably, the biasing includes an upward inclination towards the front wall provided for said base.

Preferably, the vertically adjustable biasing means provides a continuous height adjustment to accommodate a variety of pamphlet sizes.

According to a further aspect of the present invention, a pamphlet display/dispenser includes any or all of the novel features of the embodiments as described herein and/or as described with reference to any one or more of the accompanying drawings.

Further aspects of this invention, which should be considered in all its novel aspects, will become apparent from the following description given by way of example of possible embodiments thereof and in which reference is made to the accompanying drawings.

BRIEF DESCRIPTION OF THE DRAWINGS

FIGS. 1 to 6, 7*a* & 7*b* & 8: Show various views of one possible embodiment of the invention in its "upright", and "walk forward", (closed and open) modes;

FIG. 7*c*: Shows a "shelf" embodiment with its display window depending downwardly;

FIG. 7*d*: Shows a "shelf" embodiment with its display window depending upwardly;

FIGS. 35(A) to 39(D): Show various paper/pamphlet sizes in use in possible embodiments;

FIGS. 40 to 45: Show the use of an "empty notice" assembly in various embodiments;

The drawings, referred to above, utilize exclusively an A4V pamphlet display/dispenser unit to illustrate the invention and design elements of the system. The systems of the present invention and design elements also relate to all other standard and non standard size units, as will be appreciated by those skilled in the relevant arts.

The pamphlet display/dispenser unit of the present invention is also conceived to be a multi-media presentation module offering, via its front, back and top windows, a video screen for live and recorded presentations, Internet services, and one-on-one customer/client audio/visual interaction.

DESCRIPTION OF PREFERRED EMBODIMENTS

To the present time, pamphlets have been presented for display and dispensing as an exposed stack facing one direction, presented in display/dispenser units designed upright, for wall mounting applications or designed on an angle leaning back, for counter top applications.

The pamphlet container unit assembly of the present invention includes a container with a substantially parallel front and back wall, connected by way of a left and a right side wall and a base plate, open at the top, providing a cavity into which a number of pamphlets can be placed, to in turn be retrieved one by one. There are many details and holes incorporated in all walls and the base that are relative to special design features and functions.

In the accompanying figures, Multi-window, Upright ("closed" mode) and Walk-forward ("open" mode), "Beneath" and "On" shelf mode pamphlet display/dispensers are shown. The present invention typically incorporates four display windows in a unique pamphlet display/dispenser design that is instantly adaptable to wall mounting, counter top mounting, and shelf mounting applications, and, as will be demonstrated herein, also incorporates many other unique, new and useful elements of original invention.

Figure 1:
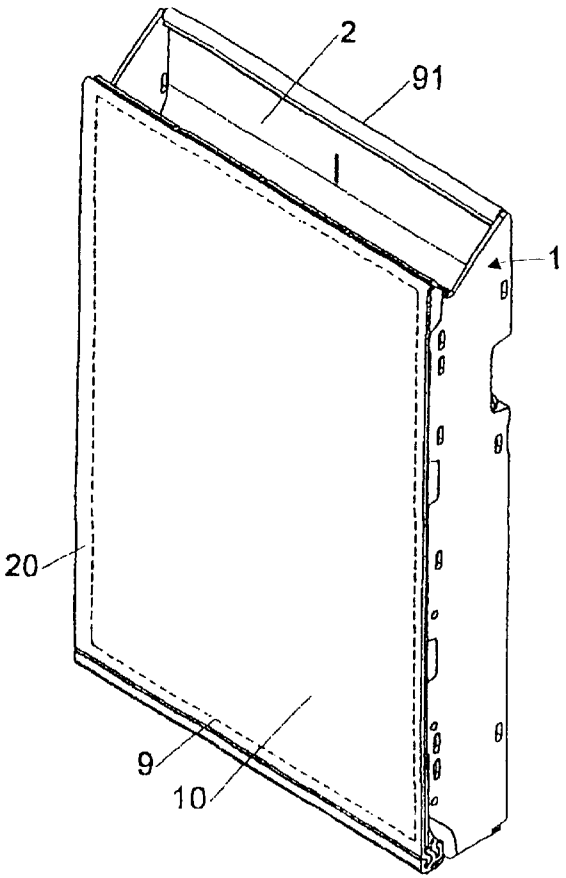

Referring to FIGS. 1 to 8 and in particular FIG. 1, this front view shows the basic pamphlet container unit 1, the pamphlet container cavity 2, the walk-forward front window 10 (in its closed position), an entrapped pamphlet 9 represented by a dotted line, and the front window coloured backing card 20. Also, an omega profiled capping strip 91 is shown along the upper edge.

Figure 2:
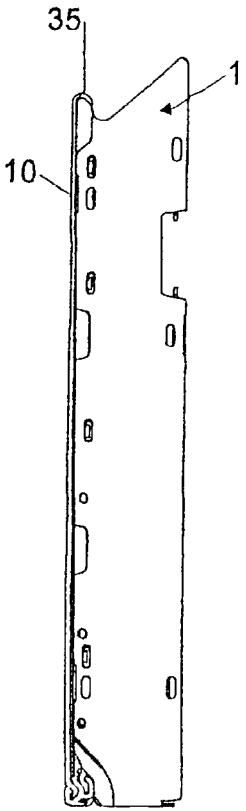

In FIG. 2, the side view shows the side wall of pamphlet container unit 1, the side view of front window 10 and a front window hinge 35.

Figure 3:
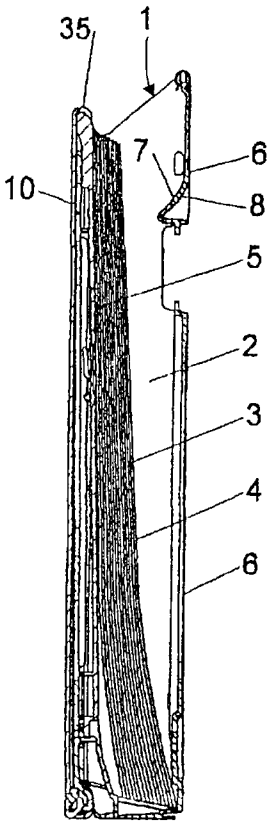

The FIG. 3 side/section view shows pamphlet container unit 1, with the container side wall removed to expose pamphlet container cavity 2, the pamphlet container unit's front wall 5, the pamphlet container unit's back wall 6, the pamphlet stack 3, the finger guide 7 to direct the pamphlet retrieval finger to the rear most pamphlet 4. The finger guide 7 also provides a preferred spacer between the container's inside back wall 6 and the rear most pamphlet 4 to ensure a finger still has room enough to access and retrieve a pamphlet 4, (in the event the pamphlet container cavity has been over filled). Finger grip 8 can provide a good four finger grip, whilst, at the same moment, the thumb of the same hand is pressed to the front window 10 to complete the gripping/carrying action of the four fingers to grip 8.

Figure 4:
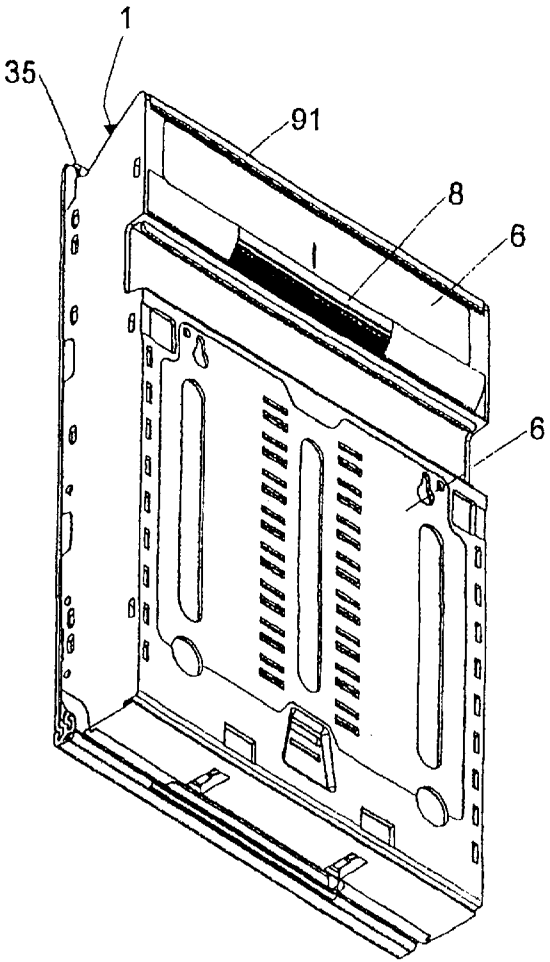

The FIG. 4 back view shows back wall 6 (without the back window option), finger grip 8, of pamphlet container unit 1, and part of the hinge 35.

Referring now to FIGS. 5 to 8, which show a basic unit in its walk-forward open mode (before any options are incorporated).

The walk-forward, front window open mode, is designed for self standing counter top applications, where a unit is usually in a position lower than eye level. In the walk-forward open mode, the angle front window, and its entrapped display pamphlet, are presented at an ideal look-up-at-you angle of view. Alternatively, the unit can be stood upright on its base (with the aid of engagement with the counter strip component 110, refer FIG. 62).

Where the unit is mounted upright, (refer FIG. 23A), the font window may be positioned open, again, in the ideal look-up-at-you angle, to the same good effect.

Figures 5, 6, 7A, 8:
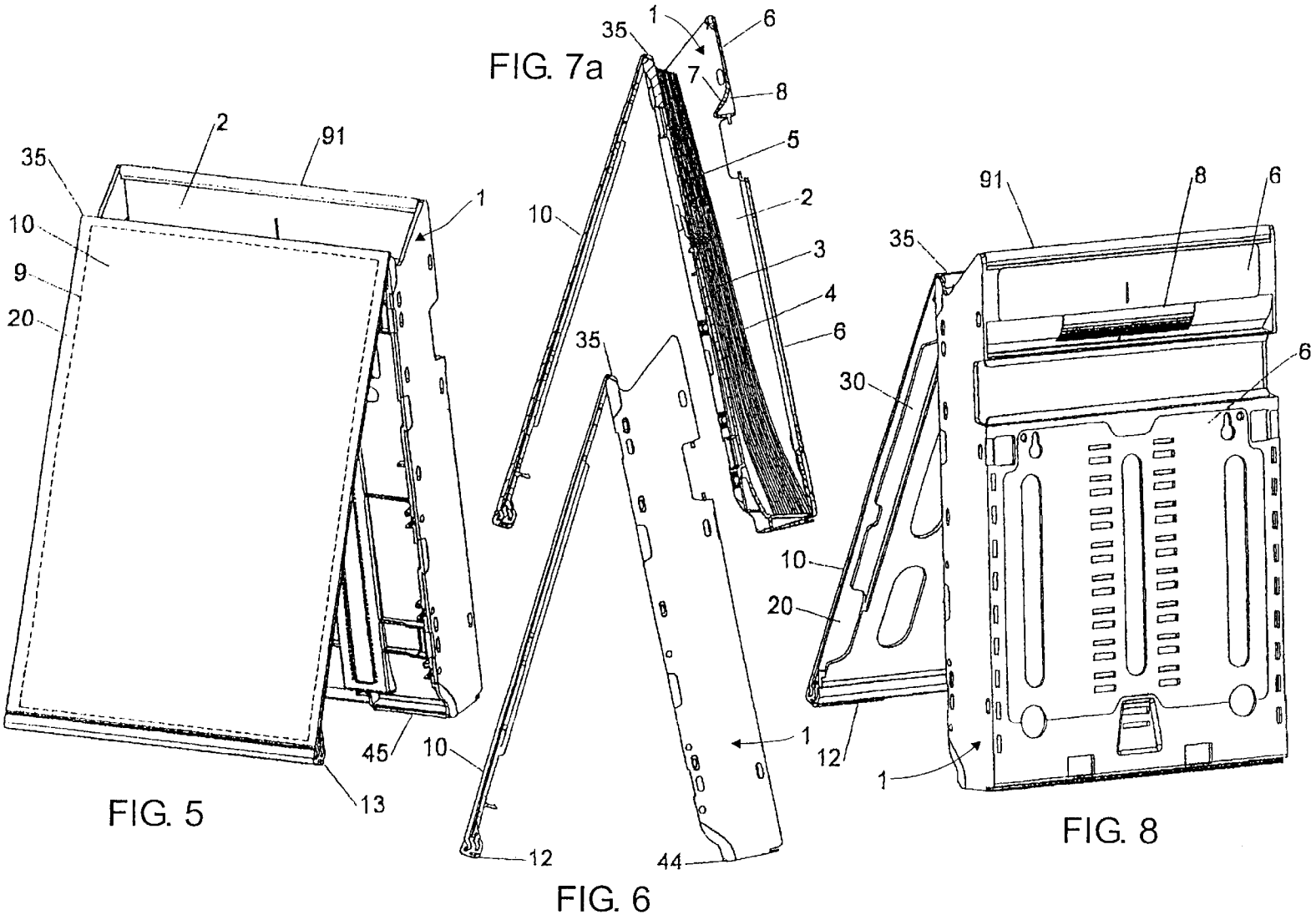
Figure 13:
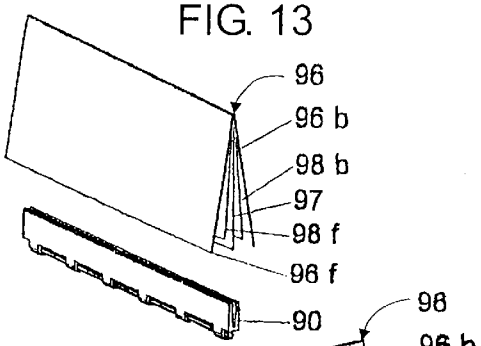
FIGS. 13 & 14: Show a top window assembly with detail, according to one possible embodiment and with FIG. 14 showing the top window holder in various possible positions.

FIG. 5 front view shows pamphlet container unit 1, front window 10 in the open walk-forward mode, complete with entrapped display pamphlet 9, front window backing card 20, hinge 35 and cavity 2.

FIG. 6 shows a Basic Unit in its Walk-forward Open Mode (before any options are incorporated).

Both FIGS. 6 and 7*a* show pamphlet container unit 1, hinge 35, and front window 10 in the open walk-forward mode. FIG. 7*a* shows a view with the pamphlet container unit side wall removed to expose pamphlet container cavity 2, the pamphlet container front wall 5, the pamphlet container back wall 6, the pamphlet stack 3, the finger guide 7 to direct the pamphlet retrieval finger to the rear most pamphlet 4, and finger grip 8.

The container assembly typically consists of two primary pieces, a container front piece and a container back piece that are designed to click together as one by pressing both pieces together. Two rubbery counter grip pieces 44 (FIG. 6) may be installed in the slots 45 (FIG. 5) provided in the container's front bottom edge. At the top of the container's back wall, there is top window hinge detail, which (in the absence of the top window holder hinge component) may be discretely hidden by an omega profiled capping strip (91, FIG. 1). The container's top front edge consists of walk-forward front window hinge detail detailed in particular Figures.

The walk-forward front window assembly typically incorporates a variety of elements, a flat, high clarity, flexible, pull open, spring shut display window; a display cavity, in which a full size pamphlet is entrapped; a display cavity coloured backing card to provide a contrasting defining border, to enhance the impact of the entrapped pamphlet; a front window backing plate—to provide the rigidity to the whole front window assembly and also provide a hinged connection to the pamphlet container unit; an assembly rail at the foot of the front window assembly, complete with a pair of rubbery counter gripping pieces 12 (FIG. 6), which may be installed in the slots provided in the assembly rail 13 (FIG. 5), the assembly rail tying together all the elements in one assembly. The front window pulls open at the top to install or retrieve an entrapped display pamphlet, then springs back into a closed position against the entrapped display pamphlet. The backing card and backing plate have a hole through which finger tips can access the back of an entrapped displayed pamphlet to square it up within the front display window. A hinge at the top of the assembly, allowing the whole front window to swing out from the unit, may provide a self standing counter unit FIG. 6, or may be swung in against the unit to assume an extremely neat and efficient upright wall mounted unit FIG. 7*b*, or with the dispenser horizontal, 7*c*, 7*d*, the window can be swung independently to a vertical up or down orientation. When a number of units are joined side-to-side, a dome and a recess on th side of each front window assembly may lock a row of units front windows so the front windows move open and close as one.

FIG. 8 back view shows pamphlet container unit 1, hinge 35, back wall 6, finger grip 8, an edge view of front window 10, a partial view of the front window back plate 30, and front window coloured backing card 20. Also shown is the top window capping strip 91.

In FIG. 7*c*, the container unit 1 is shown mounted beneath a shelf 501 with its front display window 10 slung downwardly. In this way, the pamphlets 3 may be retrieved horizontally. In FIG. 7*d*, the container unit 1 is positioned on a shelf 105 with the front display window 10 extending upwardly.

It is seen that the hinge 35 permits the under shelf and on shelf modes to have the display window 10 positioned to face the viewer while the container 1 is dispensing in a horizontal mode.

FIGS. 9, 10, 11, 12 and 13 show a top window 96, complete with a coloured top window backing card 97, display art 98*f* and 98*b* presenting both a forward facing top front window 96*f* and a backward facing top back window 96*b*, all components mounted in the hinged top window holder 90.

The term "coloured" used throughout this specification would include "black".

Figure 11:
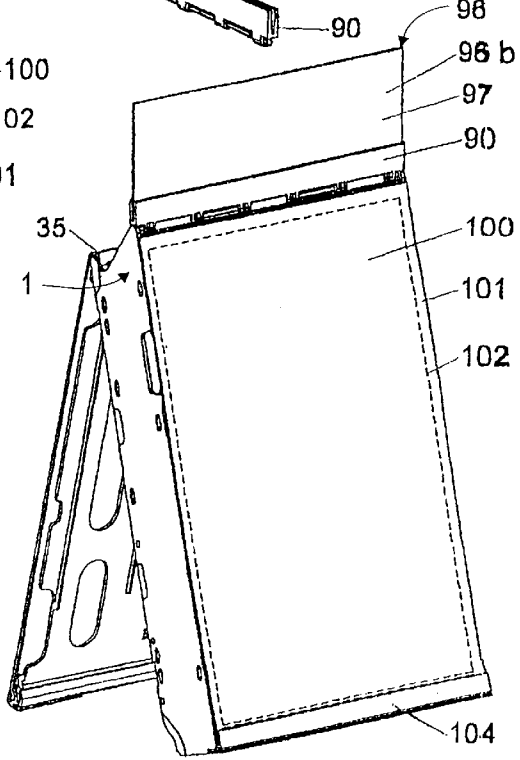
FIGS. 11 & 12: Show rear and side views of one possible embodiment.
Figure 10:
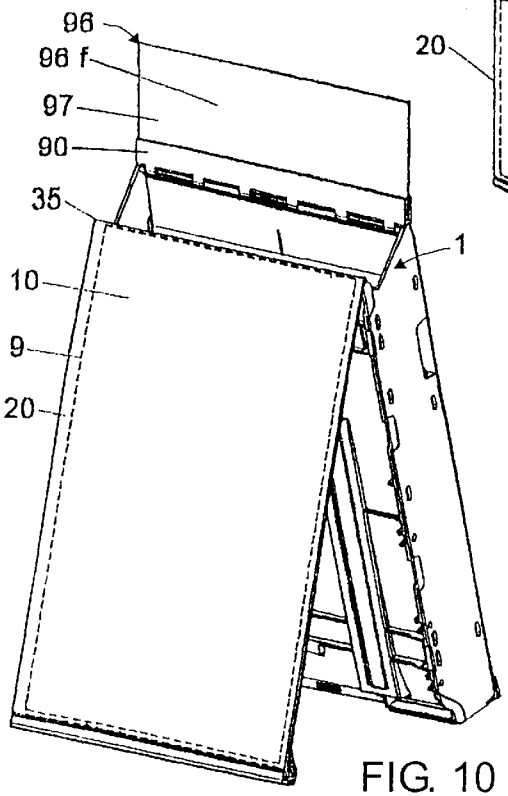

FIGS. 10 and 11 show the pamphlet container unit 1, in its walk-forward mode, the front window 10, and the back window 100 positioned astride by way of a hinge 35, located at the top front of the pamphlet container unit 1, to effectively transform the unit into a self-standing counter display, presenting both a front and rear facing display window, both orientated at an angle to present the most effective, "look-up-at-you", angled presentation from a counter top, and a hinge top window holder 90 with its top window 96 showing both front and back facing views.

Figure 12:
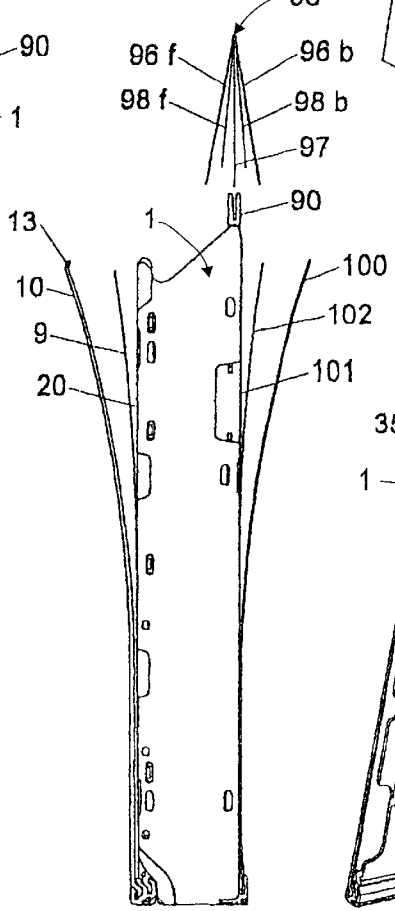
Figure 9:
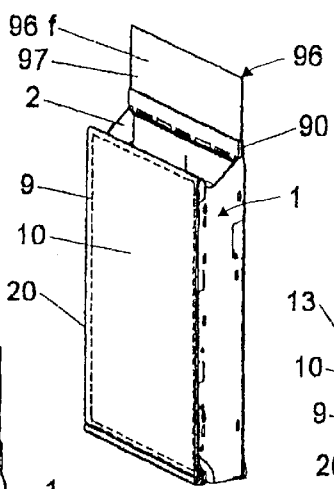
FIGS. 9 & 10: Show the dispenser according to one embodiment in two possible positions.

FIG. 12 particularly shows collectively, how all four display windows are accessed to load and retrieve displayed items. Front window 10 is pulled forward enough to access displayed pamphlet 9 and show the coloured backing card 20. The back window 100 is pulled backward enough to access displayed pamphlet 102 and show the coloured backing card 101. The top window 96 is lifted from the hinged top window holder 90, in order to insert or retrieve display art 98*f* and 98*b*.

The top window 96 is shown in this embodiment in a mini size (¼ A4), otherwise, a top window 96 may be available in all European and US paper and pamphlet sizes.

In application, a pamphlet cover view could be shown accommodated in all four windows, or as appropriate, mixed front cover and inside page views of the same pamphlet, say a cover view within top front display window 96*f*, FIG. 10, and also a cover view within top back display window 96*b*, FIG. 11, and the more informative inside pamphlet page view within the front display window 10, FIG. 10 and also within back display window 100, FIG. 11, thus, providing uniquely, a multi faceted presentation of pamphlet views from one unit. (See some display options incorporating all display window views in later figures.)

Figure 14:
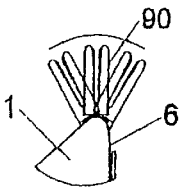

FIG. 14 shows back wall 6 of unit 1, the hinged top window holder 90 and how it can change its presentation angle to suit.

Referring now to FIGS. 15 to 20, these show the action of a front window hinge structure 35 suitable for use in a possible embodiment. The front window hinge 35 may be an essential element of this particular embodiment of the invention, providing the unit with the unique ability to open and close at will, to instantly provide an upright wall mounted pamphlet display/dispenser, a self standing counter top pamphlet display/dispenser, or an "under shelf" or "on shelf" mounted display dispenser complete with a full pamphlet height front display window in each mode. Additionally, the hinged front window facilitates the unique use of the otherwise unused back wall of a pamphlet holder, to provide a full size pamphlet height, back display window together with the unique introduction of a hinged top window holder, thereby providing in one unit, a multi four window pamphlet display/dispenser. The unique design and function of the hinge invention also provides an extremely neat, compact, slim-line hinge profile, contributing substantially to the essentially unobtrusive subtle look of the unit in application. The unique hinge application to a pamphlet display/dispenser may provide a new and uniquely useful pamphlet display/dispenser unlike any previous proposal.

Figure 15:
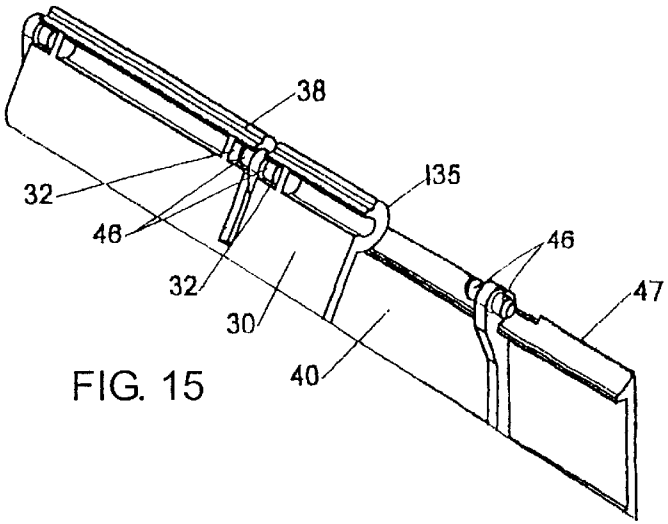
FIGS. 15 to 20: Show a top hinge assembly with detail, according to one possible embodiment.

FIG. 15 shows a cut away view of the front window walk-forward hinge assembly consisting of two components, one—the hinge cup 135 of hinge 35 along the top edge of front window back plate 30, and two—the hinge axles 46 along the top edge of the pamphlet container front piece 40, the hinge axle cavity 32, front window cosmetic curl receptor 38, and friction plate 47 are also shown.

Figure 16:
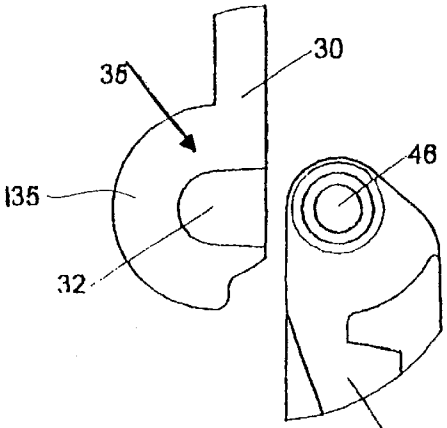

FIG. 16 shows front window back plate 30 and hinge cup 135 in a position 180° open, and the axle cavity 32 positioned ready to engage with axle 46 located at the top of pamphlet container unit front piece 40.

Figure 17:
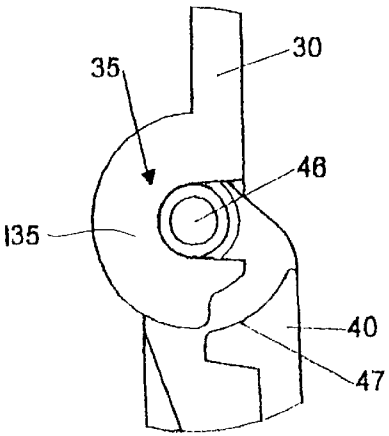

FIG. 17 shows front window back plate 30 and hinge axle cavity 32 at 180° open, now engaged with hinge axles 46, with leading edge of hinge cup 135 positioned ready, on rotation, to engage with hinge friction plate 47 to provide hinge friction, in order that the hinge and front window stay put at a set angle open.

Figure 18:
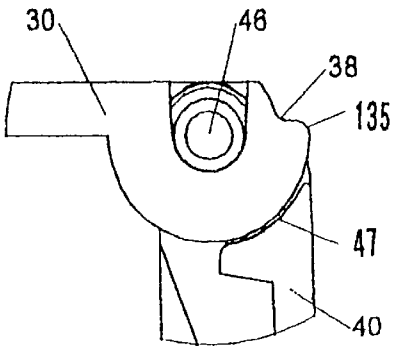

FIG. 18 shows window back plate 30 at 90° open, the leading edge of hinge cup 135 having been rotated around between the axle 46 and the friction plate 47 to trap the hinge cup 135 to its axle 46.

Figure 20:
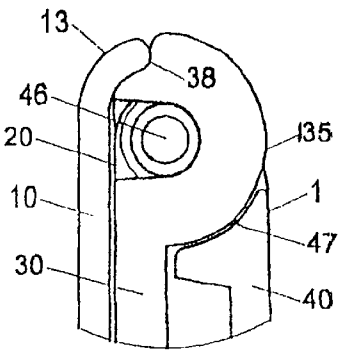
Figure 19:
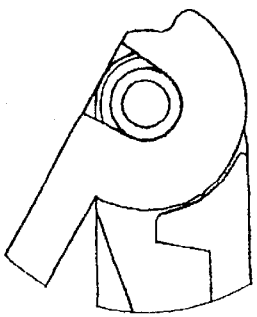

FIG. 19 shows the continued rotation of the back window plate 30 and FIG. 20 shows the hinge action in the closed position complete with front window 10 in place with its cosmetic curl 13 being accommodated by its receptor 38 to provide a smooth transitional radius to the hinges top edge. This provides a very pleasing slip compact hinge profile hardly noticeable when a complete unit is viewed from the top or the side, nor is there any hinge mechanical bulk evident on the inside of the pamphlet container unit 1 to hinder or compromise the finished units inner space or function.

When the unit is open, in the walk-forward mode, rubbery counter grips may grip the intended display counter surface to aid unit performance in a variety of applications—to add stability to the unit on slippery, high polished, static surfaces and on moving, vibrating surfaces where the unit is utilized in a moving vehicle, such as tourist cruise boat, a train, aeroplane, hovercraft, etc.

Counter grips 12 and 44 may be installed in both the back edge of the assembly rail at the base of front window assembly 10 and the container front wall 5 bottom front edge, see FIGS. 6 and 8.

A back window of various embodiments may utilize the outer back wall of a pamphlet holder to display a full height entrapped pamphlet within a flat high clarity, flexible, pull open, spring shut, back window piece, complete with enclosed backing card, to enhance impact of the entrapped display pamphlet. The back window provides the same high standard of presentation and the same advantages as those offered by the front window display. In fact, back window can offer more unique features and benefits.

When the front window is closed and upright, so is the back window. When the unit is utilized in the open, A-frame, counter top mode, the back window angle corresponds to the angle assumed by the front window. There is as much display impact with the back window as there is with the front window. This front and back window display is particularly useful in open, walk around display locations. By utilizing a counter strip component, the unit also can be stood vertically upright on a counter in both the closed upright mode or a front window open upright mode to display both front, back and top windows.

An added advantage is, that if a back window is put against a glass door or shop window, it is viewed from the outside during and after business hours. The front window is of course viewed and accessed from indoors.

A further advantage is that a back window view can also advantage those committed to that view, say those behind a service counter. By providing, on the back view, a view consistent with a customer's view from the front, the back view can then become a helpful sales prompt to counter staff. The back window view also exposes service counter staff to ongoing brand and product images, and or at the very least, provides a more cheerful view than the unadorned backside of a promotional display.

The back window feature is an integral part of the units design, of one preferred embodiment, but it is designed to be detached, in the event the end user declares it is an unwanted feature in a given set of circumstances.

Referring now to Referring now to FIGS. 21 to 24(E), FIG. 21 shows the pamphlet container unit 1, in its upright mode presenting a forward facing, entrapped, full size display pamphlet (dotted line) 9, against a coloured, which may be black, front window backing card 20, within the front window display 10.

Figure 21:
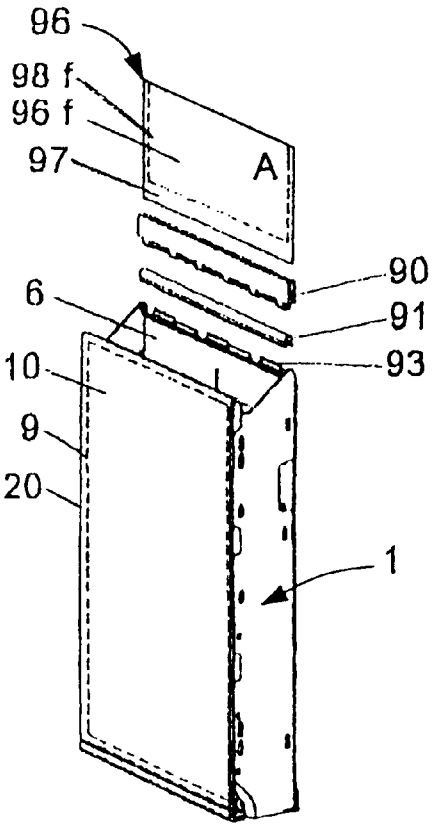

FIG. 21 also shows in the front view of unit 1 with front window 10, entrapped pamphlet 9 and backing card 20, a top window hinge 93, top window hinge omega capping strip 91, top window holder 90, top window 96A which can be the size of any of a number of the European and US pamphlet and paper sizes, top window 96*f*, lop window entrapped art/signage/pamphlet etc 98*f* and top window backing card 97.

Figure 22:
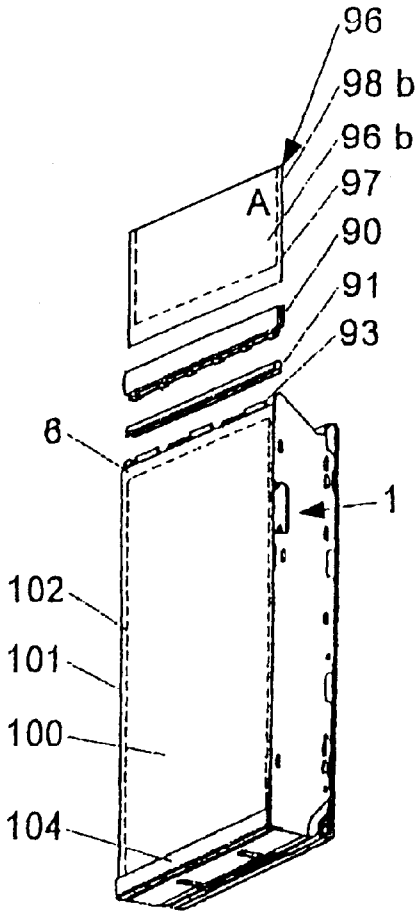
FIGS. 21 to 23(E): Show front, back, and side views of one possible embodiment of the invention.

Referring particularly to FIGS. 21 and 22, these show various display window views and how the pamphlet display/dispenser of this embodiment can be used to greater effect.

Figure 23E:
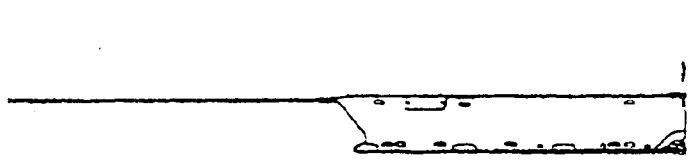
Figure 23D:
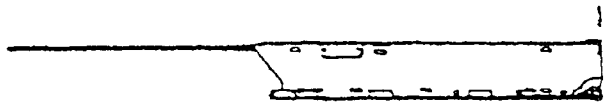
FIG. 23(F) is a detail view of the counter mounting component.
Figure 23C:
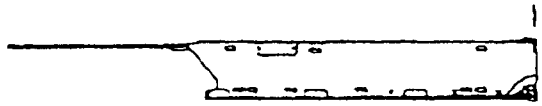
Figure 23F:
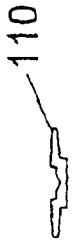
Figure 23B:
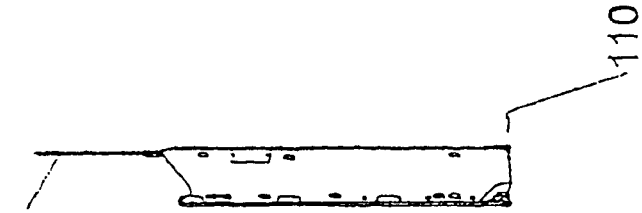

Referring now particularly to FIGS. 21, 23B, C, D and E, the upright, front window closed mode, is designed for wall mounting applications, where a unit can be positioned wall mounted at (or near) eye level to display the front window and its entrapped display pamphlet to the greatest effect. Alternatively, the unit can be stood upright, "closed", on its base, (with the aid of the counter strip component 110, FIG. 23F, refer later FIGS. 63 to 68) mounted on a high counter or high eye level shelf to the same good effect.

Figure 23A:
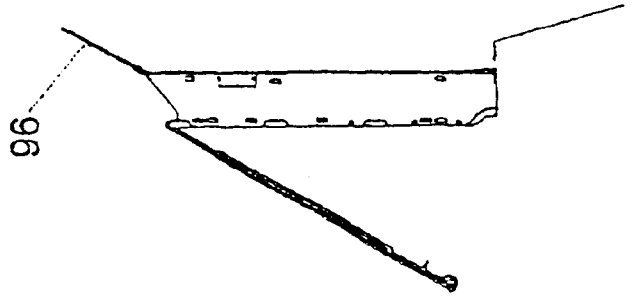
Figures 24A, 24B, 24C, 24D, 24E:
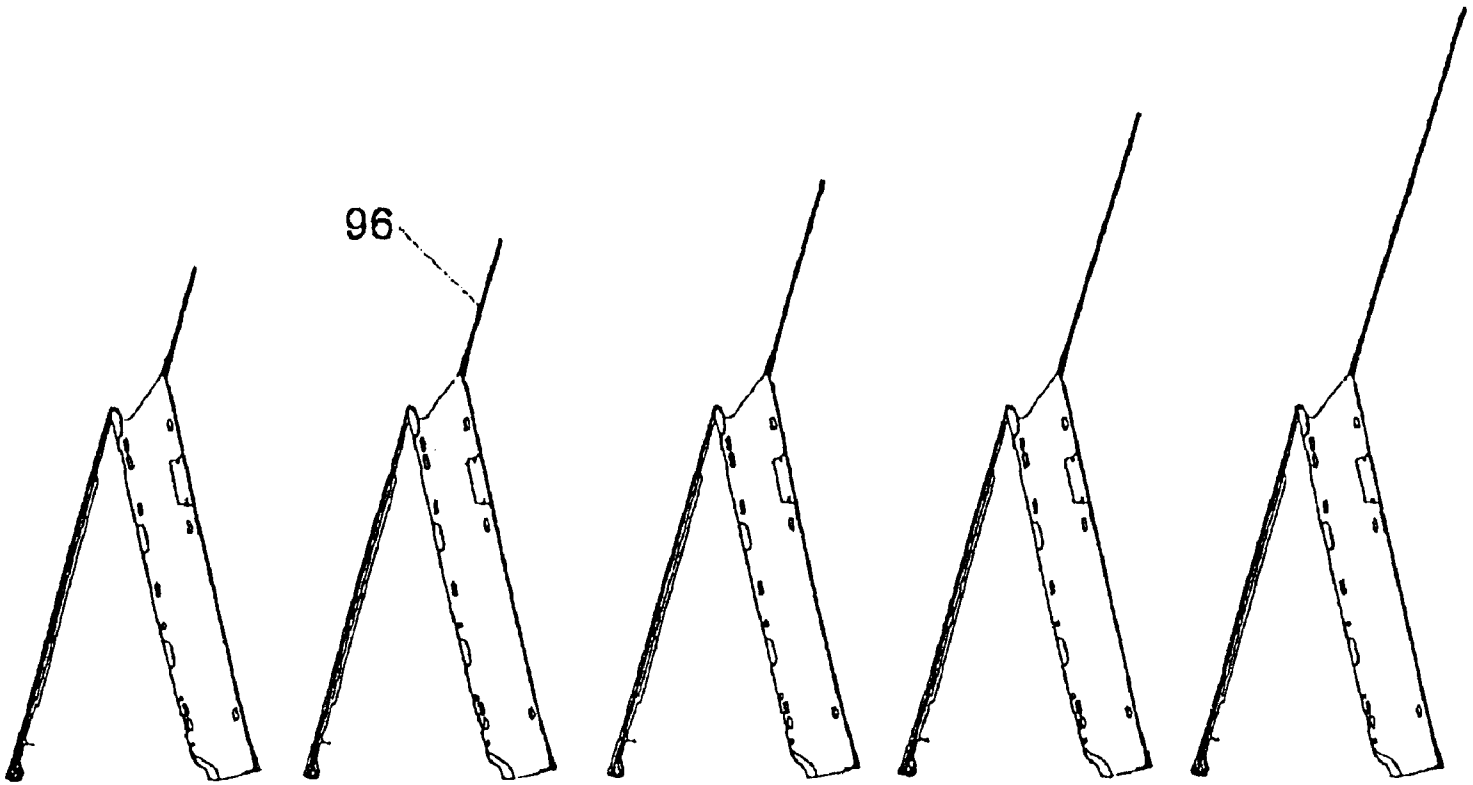
FIGS. 24(A) to 24(E): Show side views of one possible embodiment of the invention in counter-top mode.

Alternatively, as in FIG. 23A, the unit can, with the aid of the engagement of the counter mounting component 110, be stood upright, "open" in an ideal "look-up-at-you" display, when mounted to a counter or shelf at lower than eye level.

FIG. 22 also shows in the back view of unit 1 a back window holder 104, back window 100, entrapped pamphlet 102, coloured backing card 101, top window hinge 93, top window hinge omega capping strip 91, top window holder 90, top window 96 A which can be the size of any of a number of the European and US pamphlet and paper sizes. Top window 96*b*, top window entrapped art/signage pamphlet etc. 98*b*, and top window coloured backing card 97.

FIGS. 23A to 23E show a side view of units 1, complete with top windows in a variety of top window sizes, B, C, D, E=upright wall mounted units, front window in closed mode, with top windows 96 upright against wall. A=upright, counter mounted unit, front window in open mode, with top window also at the same angle as open front window.

FIGS. 24A to E show side view of unit 1=counter top mounted, in walk-forward, open front window mode, complete with top windows 96 at an angle, in a variety of top window sizes.

Referring now to FIGS. 25 to 39, these illustrate the use of the present invention with various international paper/pamphlet sizes with multi-window pamphlet configurations.

It should be noted, that the unique biasing action of the angled base plate of the pamphlet cavity, with the unique effect of biasing the pamphlet stack towards the front wall to present the rear most pamphlet for selection, that the same biasing effect can now be replicated at any selected height or depth within the pamphlet cavity simply by sliding the angled/biased cavity depth adjustment clips up or down within the cavity to the desired point. Further, the angled/biased cavity adjustment clips have the added advantage for the end-user to decide the amount of the pamphlet stack that protrudes out of the top of the pamphlet cavity, or alternatively sliding the cavity depth adjustment clips to a position within the pamphlet cavity so that the pamphlet tops are just out of view for a neater, tidier display effect.

Alternatively, when a pamphlet cavity contains two (multiple) stacks of pamphlets or papers, each angled/biased cavity depth adjustment clip can be adjusted independently to accommodate stacks of pamphlets and papers of different sizes within the same cavity, each pamphlet stack adjustable to the same useful effects.

Referring particularly now to FIGS. 25 to 34, these show embodiments of the invention using pamphlet cavity biased depth adjustment clips and cavity divider, which can maximize pamphlet display/dispenser use.

The cavity depth adjustment clips enable the pamphlet container cavity to be adjusted in depth to accommodate a wide variety of European and US pamphlet sizes, for example.

A pamphlet display/dispenser unit using cavity depth adjustment clips, can display, store and dispense pamphlets in a wide variety of sizes and formats.

Figure 26:
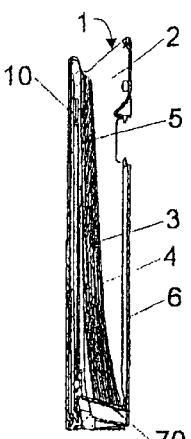
Figure 25:
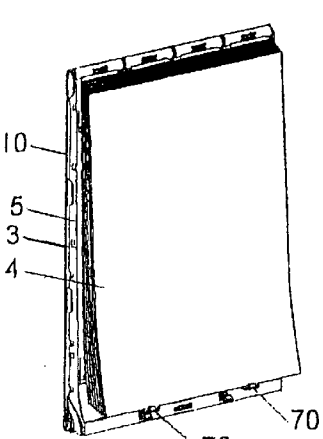

FIGS. 25 and 26 show pamphlet container cavity 2, the angled cavity depth adjustment clip 70 positioned up from the cavity base plate to bias and support the bottom of the pamphlets 3. The cavity depth adjustment clip 70 can now be moved freely up and down the cavity 2 depending on the size of the pamphlets 3.

Figure 28:
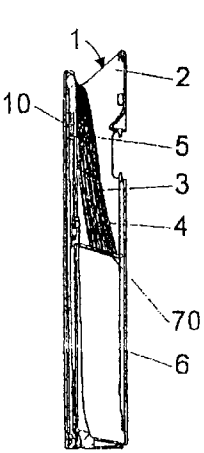
Figure 27:
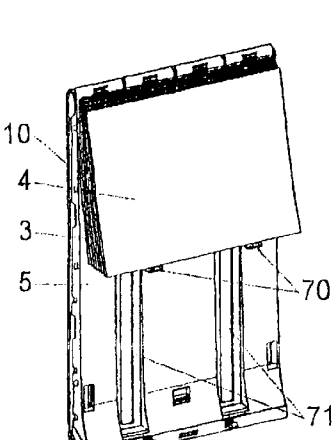

In FIGS. 27 and 28, the clip 70 has been moved vertically in channels 71 to a higher position to support narrower/shorter pamphlets 3.

Referring now to FIGS. 29 to 34 in an embodiment of the invention, a cavity width divider is provided for a pamphlet display/dispenser as a companion component to the cavity adjustment clip set.

The pamphlet cavity can be divided to accommodate several stacks of narrow format pamphlets. FIGS. 29 to 34 describe the cavity width divider and its application, whereby, popular narrow pamphlet formats can be displayed and dispensed all from the same standard size unit.

Figure 29:
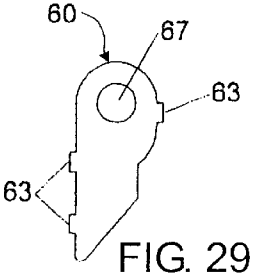

The cavity divider 60 shown in FIG. 29 has a divider handle hole 67, front and back tabs 63. The tabs 63 interconnect with the location slots provided in both the pamphlet cavity front and back walls 5 and 6, FIG. 30, to secure the cavity dividers 60 in a variety of locations across the width of the pamphlet cavity.

Figure 30:
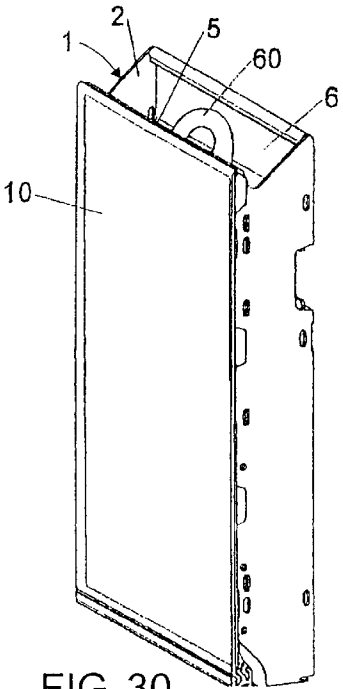

FIG. 30 shows a unit 1, with a pamphlet cavity divider 60, installed, separating the container unit 1 into two compartments.

Referring now to FIGS. 31 to 34, these show that the use of both cavity width divider 60 and cavity depth adjustment clips 70 offers a unique option.

Figure 31:
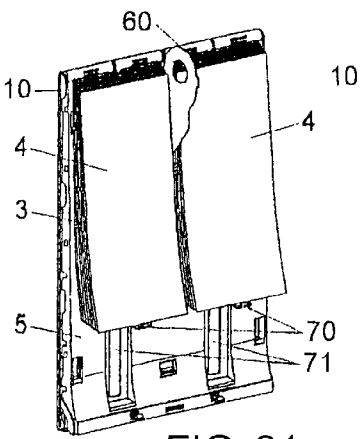
Figure 33:
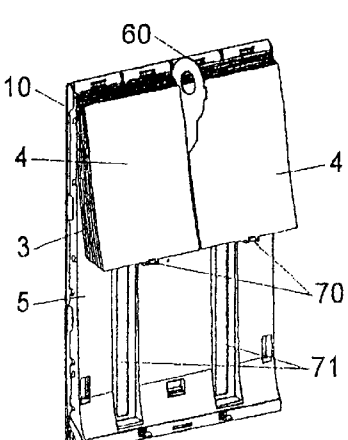

FIGS. 31 and 33 show a cavity divider 60 and the two pamphlet stacks 3, each resting on a cavity depth adjustment clip 70, each stack leaning against front wall 5.

Figure 32:
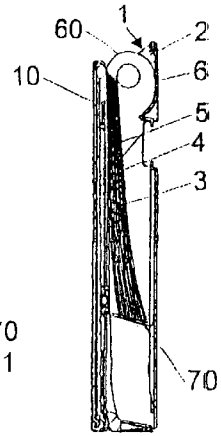
FIGS. 25 to 34: Show international paper/pamphlet sizes, both EU and US and cavity depth adjustment clips, and a divider, in use with possible embodiments.
Figure 34:
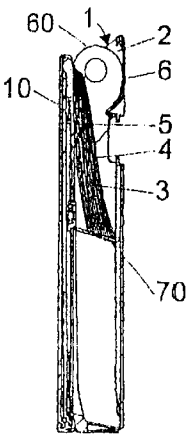

FIGS. 32 and 34 show a side/section views of unit 1, a cavity divider 60, pamphlet stacks 3, on their cavity depth clips 70, against the front wall 5, at the correct height for pamphlet withdrawal, with two different sizes of pamphlet 3 given by way of example.

By installing both a cavity width divider 60, and a set of pamphlet cavity depth adjustment clips 70, positioned on the appropriate cog or other detent in channels 71, for example, two stacks of the narrow pocket size folded travel brochures, can be accommodated side-by-side in the A4 size pamphlet container cavity for dispensing, and also sample pamphlets displayed in a variety of front cover views, and inside page views, for greater interest and promotional effect, displayed in a choice of up to four A4 size display windows per unit, or the travel brochure can be unfolded out to an A3 size displayed across two unit windows (see FIGS. 36A, 36B, and 36C), entrapped (as though glazed) by a high clarity entrapping window piece, taking the utility and quality of the presentation to a level beyond that of any hitherto known pamphlet dispenser/display units.

The ability to utilize up to four A4 display window views per unit, or more with multiple units, and the ability for the end-user or the promoter to mix-and-match display art in all top and bottom, front and back display window views, enables bot the presentation of enhanced corporate image quality, and an enhancement of the bold inside page product graphics, in all, to display in a way that maximizes the communication effect and promotional impact beyond what could be expected by utilizing standard pamphlet display dispensers.

The ability to utilise up to four A4 display window views per unit, or more with multiple units, and the ability for the end-user or the promoter to mix-and-match display art in all top and bottom, front and back display window views, enables both the presentation of enhanced corporate image quality, and an enhancement of the bold inside page product graphics, in all, to display in a way that maximises the communication effect and promotional impact beyond what could be expected by utilising standard pamphlet display dispensers.

Additionally, as the display dispenser units are modular, two or many units can be clipped together, side-to-side, to any length depending only on the space available, with a continuous uninterrupted display cavity the full length or the display to create one long interconnected row of display windows in all four window locations, top and bottom, front and back, in which any pamphlet art, graphics or signage can be displayed to provide a multi-unit, multi-window presentation, for even greater promotional impact, attention and communication.

Referring now to FIGS. 35 to 39, these show, when utilizing the cavity divider, and in some, in conjunction with the biased cavity depth adjustment clips, examples of the various mix-and-match potential with the four window display ways, utilizing also, a mix-and-match of window size options as they might relate to a whole variety of European and American pamphlet and paper sizes, demonstrating the multiplicity of a single unit and that of multiples of units, though multiple unit examples have been limited here to showing only two-unit-rows, enough through, to demonstrate the new promotional opportunities this new display dispenser system offers promoters. (Mega-multi-unit configurations shown in later FIGS. 69 to 87.)

all the following examples show only a front window and front top window view. All the following front view examples can be duplicated identically or variously, in the back window and top back window (not shown).

Figures 35A, 35B, 35C:
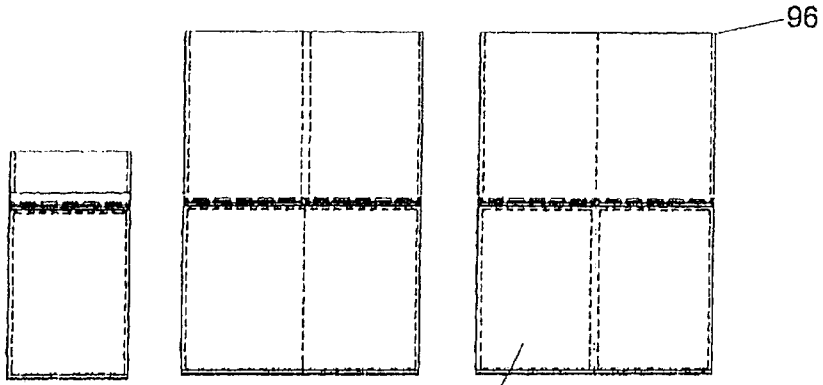

FIG. 35 EU A4/US Letter/US Magazine Formats

35A. FRONT WINDOW: outside A4 cover view. TOP WINDOW: signage.

35B. FRONT WINDOW: inside open A3 view. TOP WINDOW: outside A4 cover views.

35C. FRONT WINDOW: outside A4 cover views. TOP WINDOW: inside open A3 view.

FIG. 36 EU DLE Pamphlet/US Pamphlet (Common Travel Brochure)

Figures 36A, 36B, 36C:
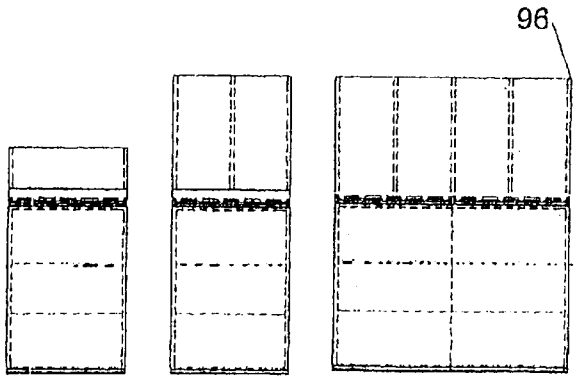

Note: cavity width dividers provide two pamphlet stacks side by side in each unit. FIGS. 36A to 36C show also the use of cavity depth adjustment to suit pamphlets height.

36A. FRONT WINDOW: inside open to A4 view. TOP WINDOW: signage.

36B. FRONT WINDOW: inside open to A4 view. TOP WINDOW: outside DLE cover views.

36C. FRONT WINDOW: inside open to A3 view. TOP WINDOW: outside DLE cover views.

FIG. 37 US Leaflet/Half EU A4

Figures 37A, 37B, 37C, 38A, 38B:
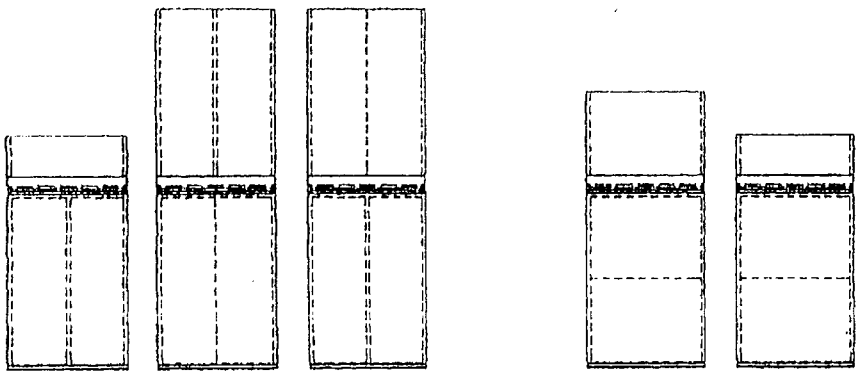

Note: cavity width dividers provide two pamphlet stacks side by side in each unit. FIGS. 37A to 37C show also the use of cavity depth adjustment to suit pamphlets height.

37A. FRONT WINDOW: outside cover views. TOP WINDOW: signage.

37B. FRONT WINDOW: inside open to A4 view. TOP WINDOW: outside cover views.

37C. FRONT WINDOW: outside cover views. TOP WINDOW: inside open to A4 view.

FIG. 38 EU A5/US Booklet/US Broadside

FIGS. 38A and 38B show also the use of cavity depth adjustment to suit pamphlets height.

38A. FRONT WINDOW: inside open to A4 view. TOP WINDOW: outside cover A5 view.

38B. FRONT WINDOW: inside open to A4 view. TOP WINDOW: signage.

FIG. 39 US Stuffer/Quarter EU A4/EU Post Card Size

Figures 39A, 39B, 39C:
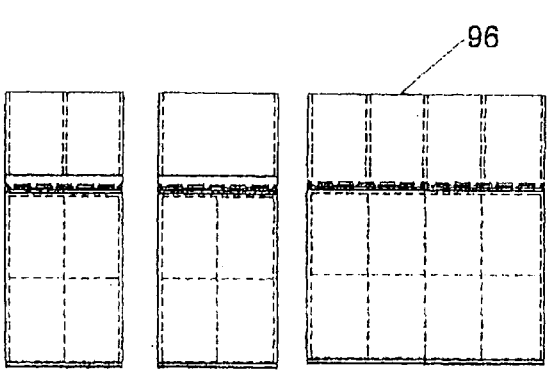

Note: cavity width dividers provide two pamphlet stacks side by side in each unit. FIGS. 39A to 39C show also the use of cavity depth adjustment to suit pamphlets height.

39A. FRONT WINDOW: inside open to A4 view. TOP WINDOW: outside cover views.

39B. FRONT WINDOW: inside open to A4 view. TOP WINDOW: inside open to A5 view.

39C. FRONT WINDOW: inside open to A3 view. TOP WINDOW: outside cover views.

Referring now to FIGS. 40 to 45, these show an embodiment of the invention embodying an "empty" notice, providing a new and useful utility to aid in the management of displayed pamphlets.

When these pamphlet display/dispensers are empty, they do not look empty, the front, back and top display windows continue to do their job, that is good, image is all, but it would still be helpful to see, at a glance, when a unit needs refilling with pamphlets.

The "empty" notice attaches and is situated between the upper inside front wall of the pamphlet container and the last pamphlet of the pamphlet stack. After the last pamphlet has been withdrawn from the pamphlet container, the pamphlet retrieval finger will instead pull up the "empty" notice, giving to staff, a clear but subtle sign that a refill is required, the entrapped display pamphlet showing clearly which pamphlet needs restocking. When the pamphlet container has been refilled, the "empty" notice is tapped down into place.

Figures 40, 41, 42, 43A, 43B, 43C, 44, 45:
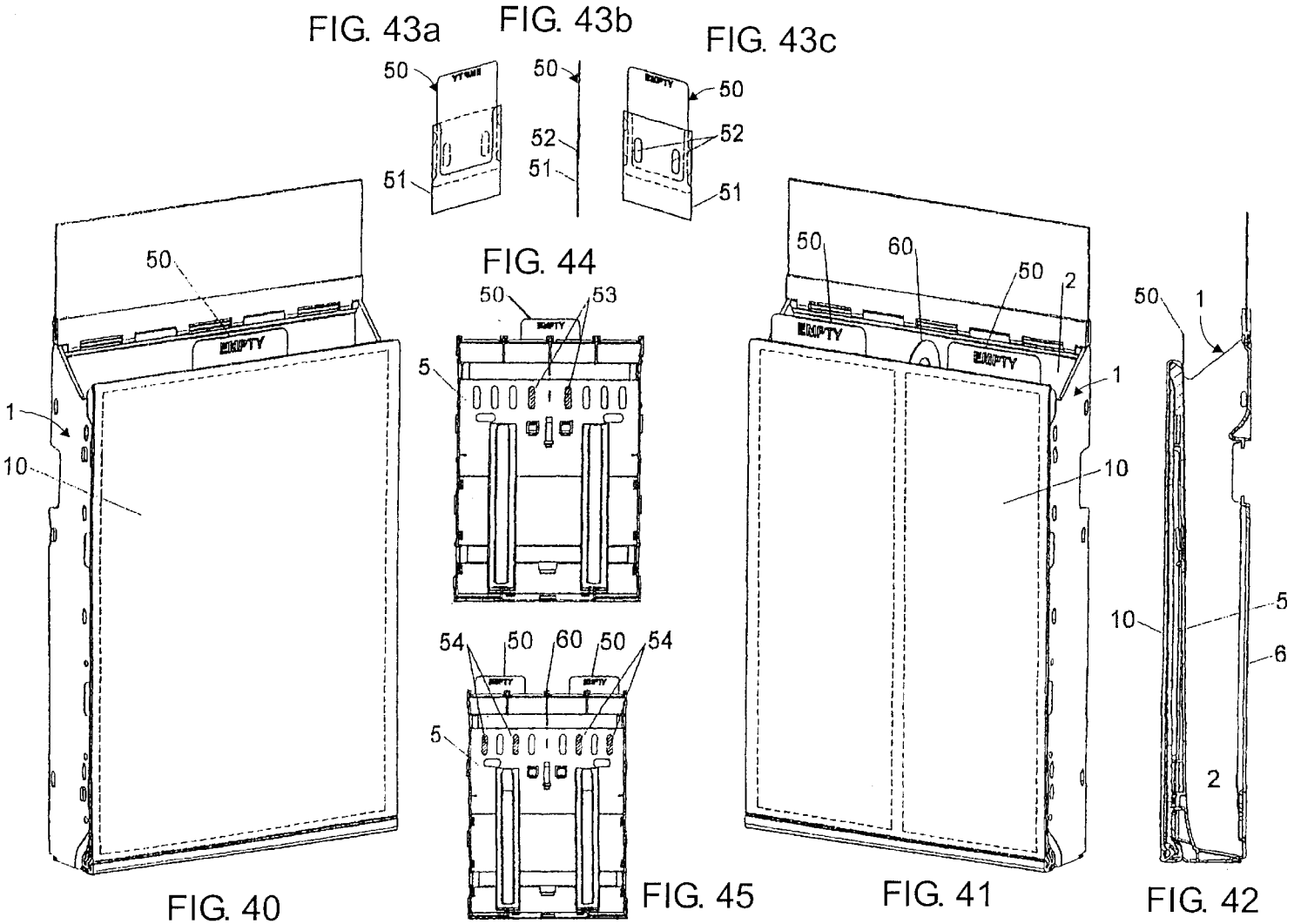

FIG. 40 shows a front view of unit 1, with its "empty" notice 50, visible in the center.

FIG. 41 shows a front view of unit 1, with two "empty" notices 50, visible, and a cavity width divider 60.

FIG. 42 shows a side/section view of unit 1, front window 10, back wall 6, front wall 5, empty pamphlet cavity 2, and "empty" notice 50.

FIGS. 43(A–C) shows a back (FIG. 43A), side (FIG. 43B), and front (FIG. 43C) view, of "empty" notice 50, its envelope 51, and its connectors 52.

FIG. 44 shows a container front wall 5, with one "empty" notice 50 attached, the two connectors 52, engaged with their two connector slots 53, in container front wall 5.

FIG. 45 shows a container front wall 5, with two "empty" notices 50 attached. Two connectors 52, engaged with the two pairs of connector slots 54, in container front wall 5, and one cavity width divider 60.

Figures 46, 47, 48, 49, 50, 51, 52, 53, 54:
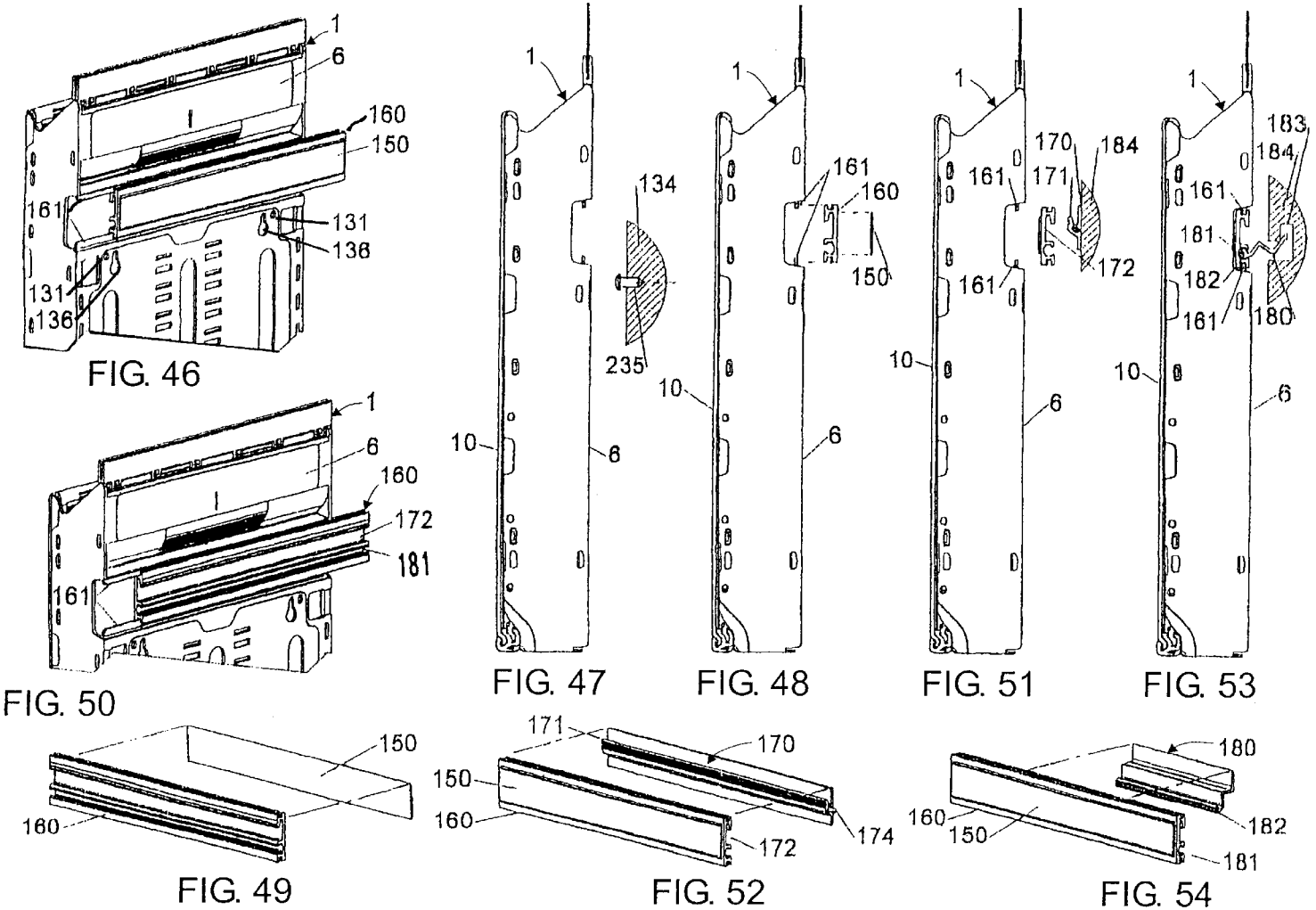
FIGS. 46 to 54: Show alternative mounting arrangements for possible embodiments.

Referring now to FIGS. 46 to 47, these show how screw fastener type mounting methods are facilitated to mount the display dispenser unit to a display wall.

In FIG. 46, the two holes 131, in back wall 6 of unit 1, are provided as suitable holes through which the unit 1 can be screwed or bolted directly to a vertical display wall, or bulkhead. This is a permanent mounting method provided for situations where that is required.

In FIG. 46, the two key holes 136, in back wall 6 of unit 1, are provided as locking key holes designed to accept the head of an exposed pan-head screw protruding from a display wall, when the unit 1 is placed in position. The weight of the unit effects a locking action, and by lifting the unit up, unlocking the locking mechanism, in this way, the unit can then be engaged on/off the display wall as required.

FIG. 47 also shows a side view of unit 1 positioned to allow the two key holes 136, in back wall 6, to engage with the protruding screw head of the pan-head screws 235, fixed into display wall 134.

Referring now to FIGS. 46 to 54, these show an embodiment of the invention using a universal mounting rail, multi-mounting system.

The universal, mounting rail, multi-mounting system is believed to be unique in its use with pamphlet display dispensers, where three mounting methods are incorporated into one universal mounting rail—Velcro™, hook rail and slot-wall—a system accommodated by sliding the removable, reversible universal rail component into the back wall of the pamphlet display dispenser unit, to provide a multiplicity of mounting ways. Three methods are described as some examples, but the new mounting system is such that it lends itself to the adaption of more, new mounting ways.

Referring to FIGS. 46 and 50, both figures show a back view of unit 1, the universal mounting rail 160, sliding in to the back wall 6, on the universal mounting guide rails 161.

FIG. 46 shows the universal mounting rail 160, installed in the back of unit showing the side with the Velcro™ tape 150 exposed to view.

By sliding the universal mounting rail 160, from the back of unit 1, and rotating it 180°, then sliding it back into the back of unit 1, the universal mounting rail will be installed exposing the grooved side to view, as shown in FIG. 50.

FIG. 50 shows the universal mounting rail 160, installed in the back of unit 1, showing the grooved side exposed to view, showing the hook-rail hook receptor groove 172, and the slot-wall toggle receptor groove 181.

FIG. 46 shows a back view of unit 1, with the universal mounting rail 160, installed in back wall 6, retained by the guides 161, with the Velcro™ tape side exposed to view. The unit 1 can now be simply pressed to a suitable loop pile fabric display wall, or alternatively, to a companion strip of loop pile Velcro™ tape stuck to the display wall for that purpose.

FIG. 48 shows a side view of unit 1, and the universal mounting rail guides 161, an end view of the universal mounting rail 160, and an end view of the Velcro™ tape 150.

FIG. 49 shows a perspective view of both the universal mounting rail 160, and the Velcro™ tape piece 150.

The applicant believes this Velcro™ engagement, incorporated into the multi way universal mounting rail system, is entirely original as it was a concept developed in the absence of any other suitable mechanism that could quick change venue to venue as mounting requirements changed.

FIG. 50 shows a back view of unit 1, with the universal mounting rail 160, installed in back wall 6, retained by the guides 161, showing the grooved side of the universal mounting rail 160 exposed, and the hook-rail hook receptor groove 172.

FIG. 51 shows a side view of unit 1, and the universal mounting rail guides 161, and an end view of the universal mounting rail 160, the hook-rail receptor grove 172, the hook-rail hook 171, of hook-rail component 170, mounted to the display wall 184.

FIG. 52 shows a perspective view of the hook-rail set, the hook-rail 170, and its hook 171, and an alignment stud 174 to ensure the hook rail aligns correctly, when butted together end-to-end, as a consolidated length along a display wall.

The display dispenser unit complete with universal mounting rail is engaged with the wall mounted hook-rail hook where it is free to slide along the hook-rail to position where the unit as required, when the unit is in the desired position. By then pulling down on the unit, it then engages with a soft co-extruded edge, a design feature that enables it to lock securely into position. Removing the unit is by reversing the process, lifting the unit 1 up a little to disengage it from the locking mechanism, the unit will then be free to slide along the hook-rail to a new position, or be able to be lifted off the hook-rail to be relocated elsewhere. The applicant believes this rail-hook engagement system is entirely original as it was a concept developed in the absence of anything suitable to do even a similar job, and as a new and useful mounting mechanism, it has been incorporated into the multiple mounting mode, universal mounting rail system.

FIG. 50 shows a back view of unit 1, with the universal rail mounted 160, installed in back wall 6, retained by guides 161, showing the grooved side of the universal mounting rail 160 exposed, and the slot-wall toggle oval receptor groove 181.

FIG. 53 shows a side view of unit 1, and the end view of the universal mounting rail 160, installed in the back wall of unit 1, contained by the universal rail guides 161. The end view of the universal mounting rail shows the slot-wall toggle receptor groove 181, with the slot-wall toggle oval 182 engaged, and the slot-wall toggle 180 hanging at an angle ready to engage with the slot wall slot 183, in display wall 184. The weight of the display dispenser fully engages the unit 1, and toggle 180, with the slot wall to provide a hidden mounting mechanism, unobtrusive, and providing for a neat flush fit to the display wall.

FIG. 54 shows a perspective view of the slot-wall mounting set, the slot-wall toggle 180, the toggles oval 182, and the universal mounting rail 160, and toggle oval receptor groove 181.

As there is no slot wall mounting method available on the market that does not show the mounting means, the design provides a hidden mechanism designed into the multi mounting mode, universal mounting rail system as a new and needed mounting option. The applicant considers this slot-wall engagement mechanism to be entirely original as it was a concept developed in the absence of any other suitable mechanism, and since, it has proved to be successful in function and provides users with a useful choice.

Figure 57:
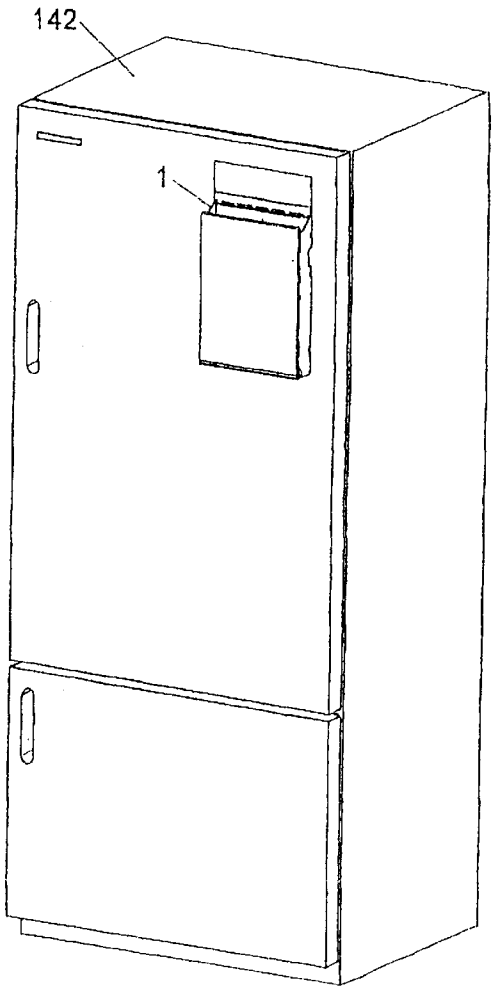
FIGS. 55 to 57: Show a magnetic mounting arrangement for one possible embodiment.
Figure 56:
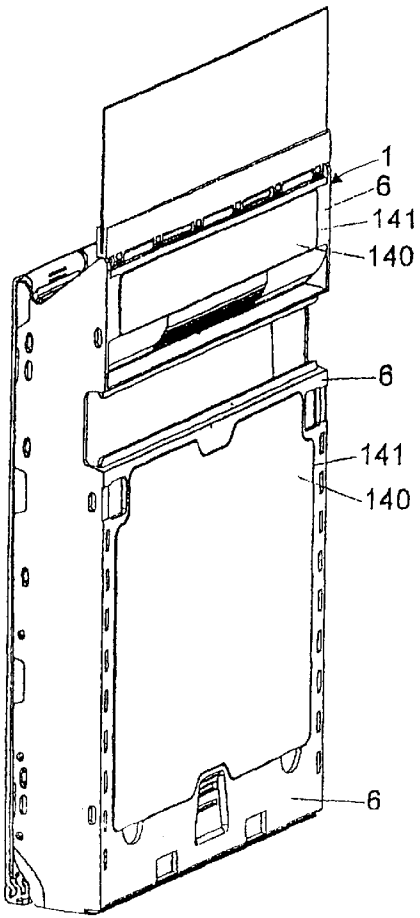
Figure 55:
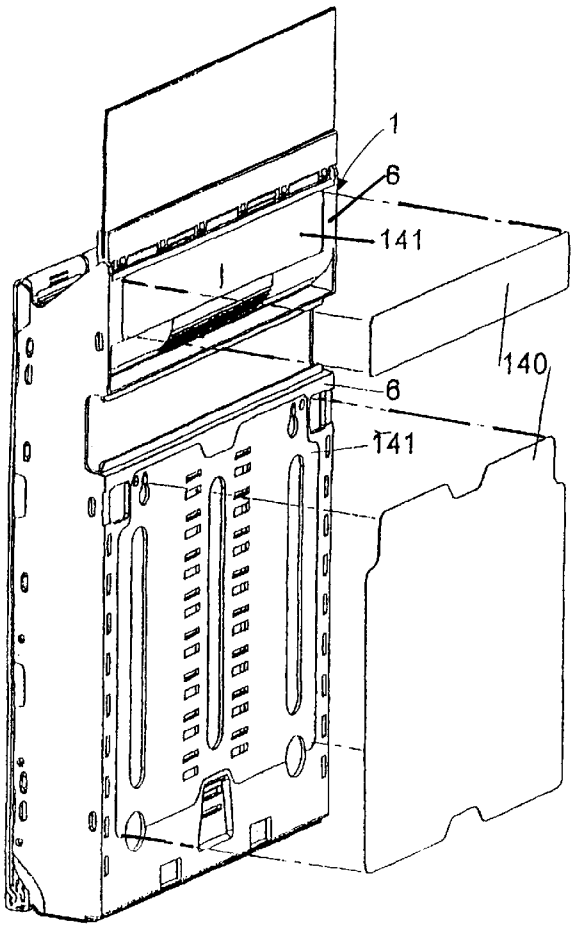

Referring now to FIGS. 55 to 57, an embodiment is shown utilizing a magnetic mat mounting.

In this embodiment, a method of mounting a pamphlet display/dispenser unit directly to a metal product, such as on a showroom refrigerator, metal bulkheads, on exhibitions of metal equipment, machines and vehicles, in warehouse, showrooms and retail spaces where metal shelving and blackboards and metal pegboard paneling is used, is provided.

Magnets have been and are used generally to hold up signage and notices but have never been powerful enough to support the substantial weight of a pamphlet display dispenser unit loaded with 100–200 pamphlets and withstand the forces and loads imposed by clients retrieving pamphlets from the dispenser.

The problems above have been resolved by, in the embodiment as shown, designing a pamphlet display/dispenser unit dedicated to that purpose, by maximizing magnet surface area so that the back wall of the unit is largely magnetic. The magnetic mat material is inset into the back wall of the unit to ensure the entire back wall of the unit is flush with the display wall surface preventing rocking leverage stress, weakening the magnetic bond to the display wall.

The magnetic mat may be a die cut component, self-adhesive one side and magnetic on the other.

The magnetic mat adheres to the magnetic mat depression, moulded into the back wall of the pamphlet display/dispenser unit.

The magnetic mat depression gives a precise location to position the magnetic mat on the back wall of the unit.

The magnetic mat depression also accommodates the magnetic mats thickness, permitting the magnetic mat to be flush with the back wall of the unit, so that when in use, the pamphlet display/dispenser unit sits neatly, aggressively firm, and flush to a receptive metal display wall, partition or product.

FIG. 55 shows a back view of unit 1, the die cut self adhesive magnetic mat 140, the moulded magnetic mat receptor recess 141, in back wall 6.

FIG. 56 shows a back view of unit 1, the die cut magnetic mat 140 adhered to back wall 6 within its magnetic mat receptor recess 141.

FIG. 57 shows a front view of unit 1, mounted to an example showroom product 142, such as the top of a refrigerator.

The pamphlet display/dispenser units are also modular and can be joined side-to-side forming rows of units, in as many unit multiples as desired, to provide a continuous display face to the observer both indoors and outdoors. Additionally rows above rows of units can be cascaded in an open space or down a glass frontage to maximise promotional opportunities.

The suspended chain cascade can be cascaded down a display face where there is no other possible or permissible mounting alternative say a feature marble wall, in front of a water wall etc.

Suspended cascade rods with a top and bottom hook are utilized to link and support each lower unit or each lower row of units as they cascade down a space or glass frontage.

Figure 58:
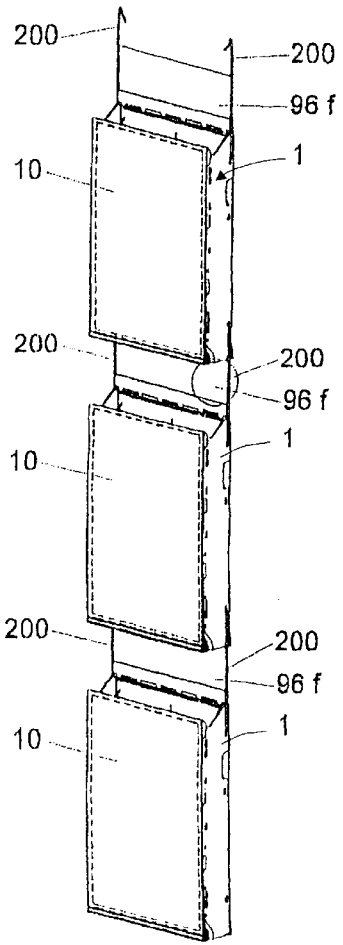

Referring firstly to FIG. 58, this sows a front view of three units 1, front window 10, top window 96*f*, in a one unit wide chain cascade, utilizing cascade linking rods 200.

Figure 59:
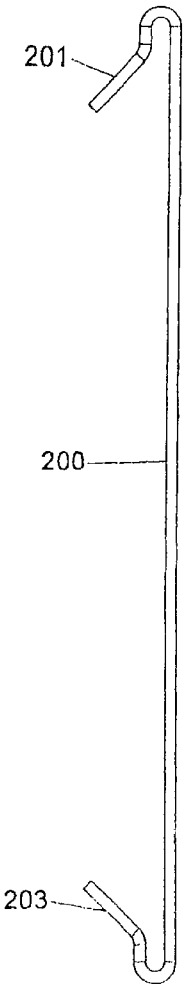

FIG. 59 shows a cascade rod 200, the top hook 201 and the bottom hook 203.

Figure 60:
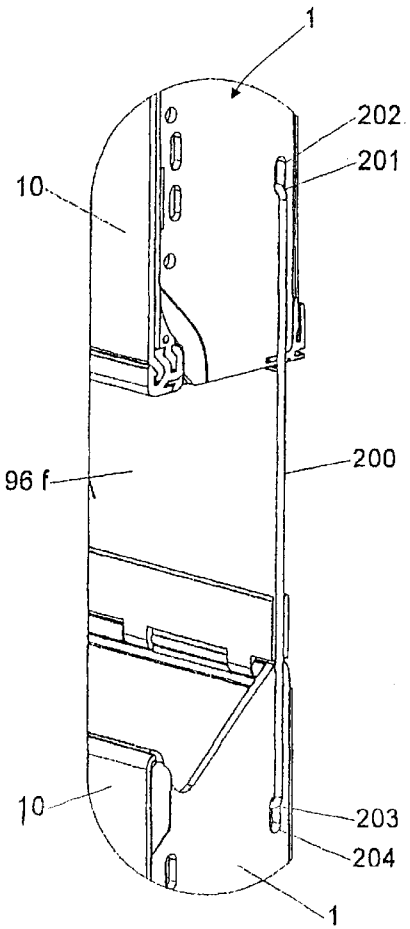

In FIG. 60, the cascade rod 200 connects upper and lower pamphlet display/dispenser units 1. The rod's top hook 201 engages with the units 1 cascade rod hook hole 202 and the rods bottom hook 203 engages with unit's 1 cascade rod hole 204. Also front window 10, and top window 96*f* in view.

Figure 61:
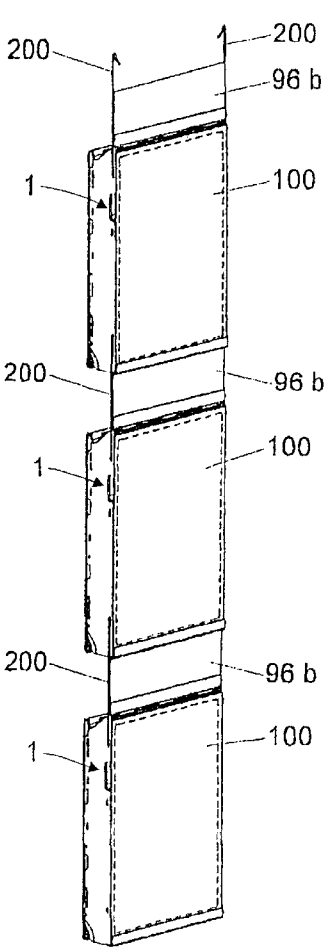
FIGS. 58 to 61: Show chain hanging arrangements of a possible embodiment.

FIG. 61 shows a back view of three units 1, in a one unit wide cascade, utilising cascade linking rods 200, and also showing back windows 100, and a top window 96*b*.

Referring to FIGS. 62 to 68, in this embodiment are used counter mounting strips providing a new and useful way to utilize pamphlet display/dispensers.

Counter space is always at a premium. Pamphlet displays and pamphlet stands do normally take up enormous amounts of counter space. For this reason many traders can not or will not display the product pamphlets they should, denying that pamphlet, the product and its producer the point of sale impact intended.

To address and resolve the above problem, the counter mounting strip was invented to provide a method of displaying a pamphlet display/dispenser in an upright mode, where it best suits a trader, as a row along the back of the counter top to provide customer and merchandising space, or as a row along the front top edge of the counter to provide the trader with a screen to his work counter space, or mounted anywhere in between.

To create such a display normally, a structure, a small wall, would be built to display on, but utilizing the counter mounting strip, unobtrusively stuck or screwed (or both) to the counter top at the front, back or down the middle, the pamphlet display/dispensers form their own structure without the need for any other expense.

On open island counters, the pamphlet display/dispensers with both a front and back window employed, provide at a moments notice an upright, two sided, two window display to increase promotional effect, and by clipping the units as one into rows, create a powerful, neat and professional display.

Along the pinnacle of two sided merchant shelving, that can be seen across, like those found in a large hardware store, the counter mounting strip can be used in a new way to maximize that near eye level promotional opportunity. A counter mounting strip can be fixed to the top edge of the central shelving panel along which pamphlet display/dispensers can be installed, the full length if required, back-to-back, providing a double row of units addressing directly merchandise on the shelving right below any one of the pamphlet display/dispensers.

The counter strip embodiment shows many new and useful uses, which will be apparent to those skilled in the art, but this innovation, in conjunction with the new pamphlet display/dispenser, invites, as never before, other new and useful uses and applications in the hands of the end user.

Figures 62, 63, 64, 65, 66A, 67B, 68C:
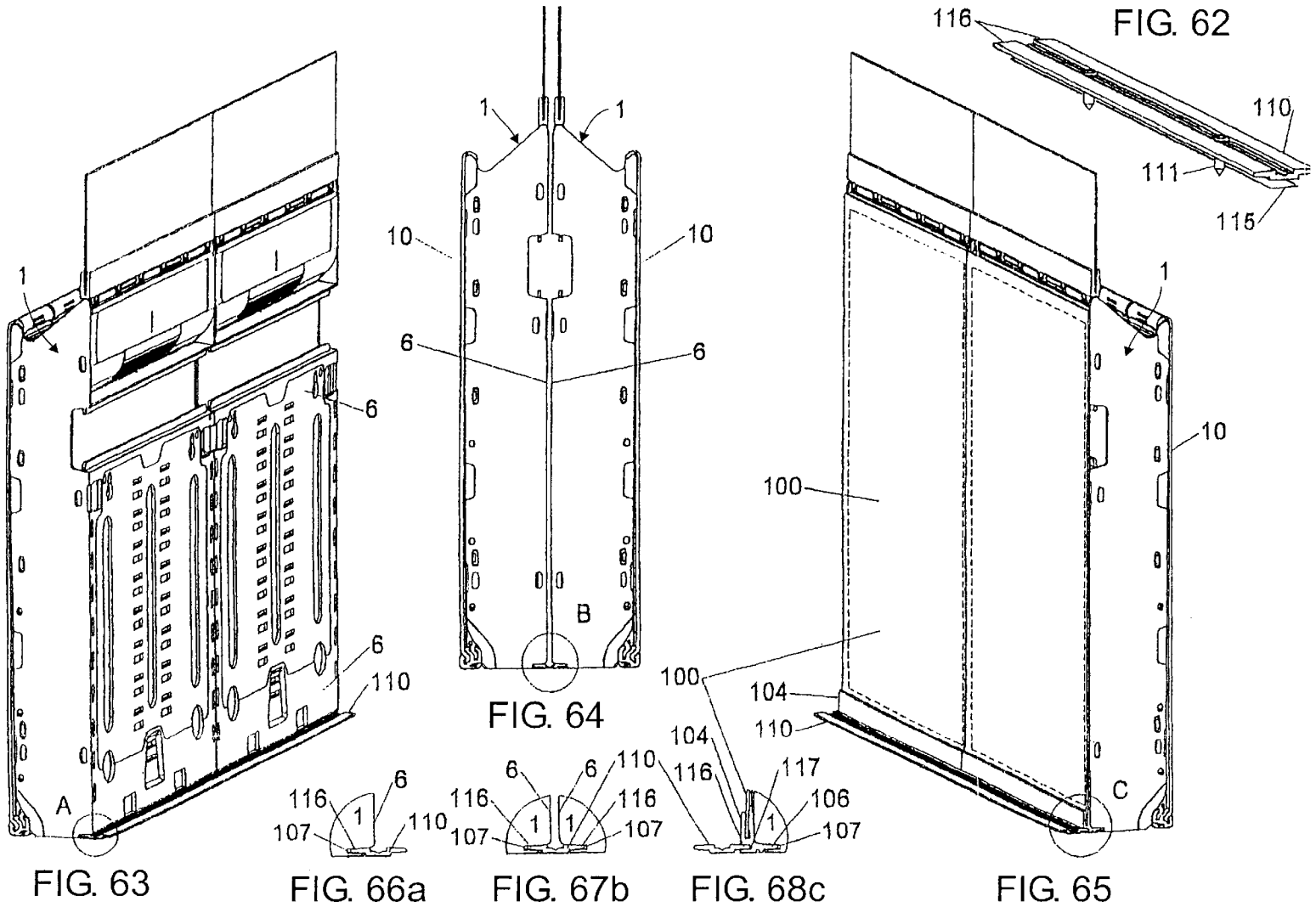
FIGS. 62 to 63, 64, 65, 66*a*, 67*b* and 68*c*: Show the use of a counter mounting strip arrangement.

FIG. 62 shows a view of the counter mounting strip component 110, screws 111, tape 115, lug 116.

FIG. 63 shows a back view of units 1, clipped together as one, back wall 6 engaged with the counter strip 110. Detail A, FIG. 66, shows the engagement of unit 1 with counter strip 110, the lug 116 in lug receptor groove 107 in back wall 6.

FIG. 64 shows an end view of units 1, engaged back-to-back with counter strip 110. Detail B, FIG. 67, shows the engagement of units 1 and lugs 116 in lug receptor grooves 107 in back walls 6.

FIG. 65 shows a back window view of unit 1, back window holder 104 engaged with counter mounting strip 110. Detail C, FIG. 68, shows the engagement of units 1, lug 116 in lug receptor 117 of back window holder 104 and its lug 106 engaged with lug receptor 107 of unit 1.

Figure 69:
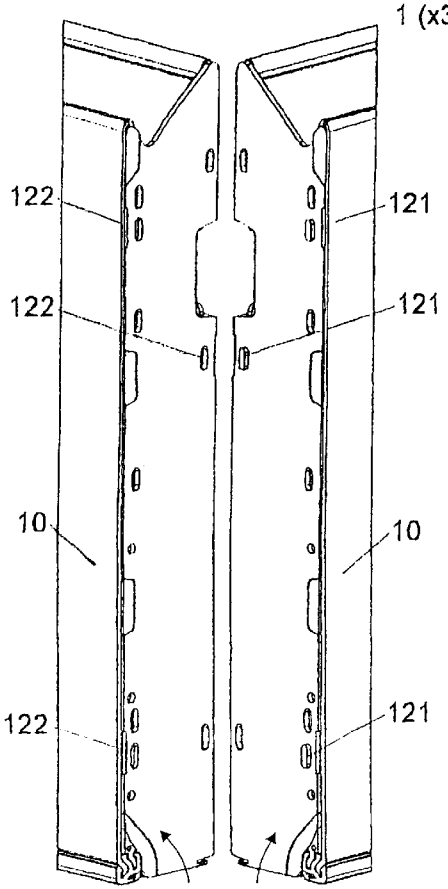

FIG. 69 shows a front and left side and a front view of two units 1, the up-stand buttons 121 and up-stand button receptor holes 122. These are to provide a substantial grip side-to-side against the load of shear forces.

Figure 70:
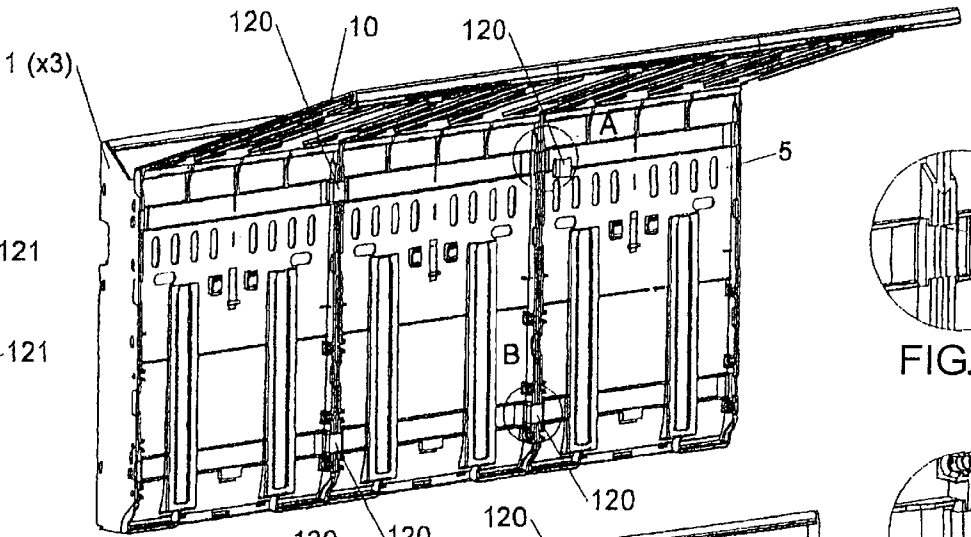
FIGS. 69 to 70, 71, 72*a*, 73*b* and 74*c*: Show row assembly arrangements of possible embodiments.
Figure 72A:
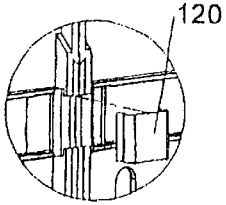
Figure 73B:
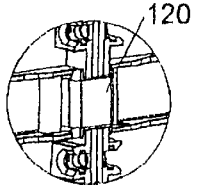

FIG. 70 shows a front view of three units 1, joined side-to-side the three front windows 10, opening together as one, to reveal how the three units 1 are joined using the row assembly clip 120. Refer also FIGS. 72A and 73B, which detail references A and B on FIG. 70.

Figure 74C:
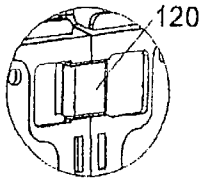
Figure 71:
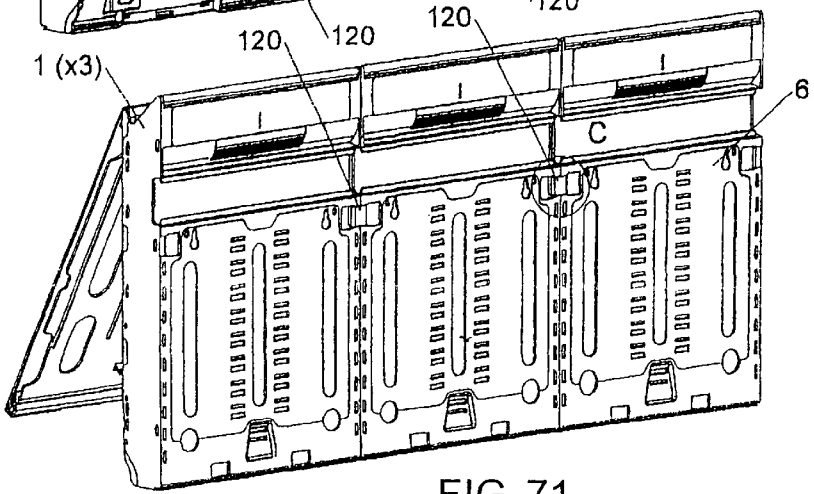

FIG. 71 shows a back view of the same three units 1, joined by way of row assembly clips 120. Refer also to FIG. 74C and detail reference C on FIG. 71.

Figure 75:
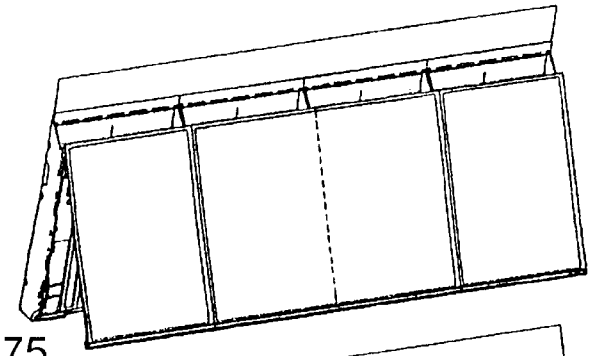
Figure 76:
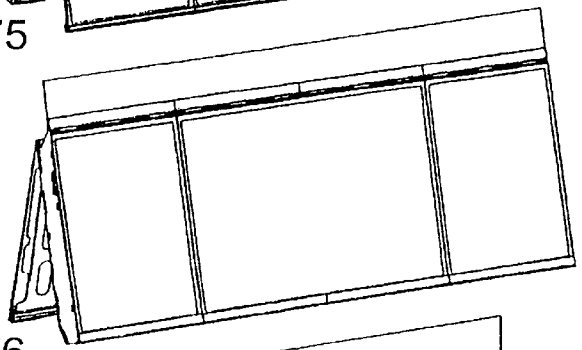
Figure 77:
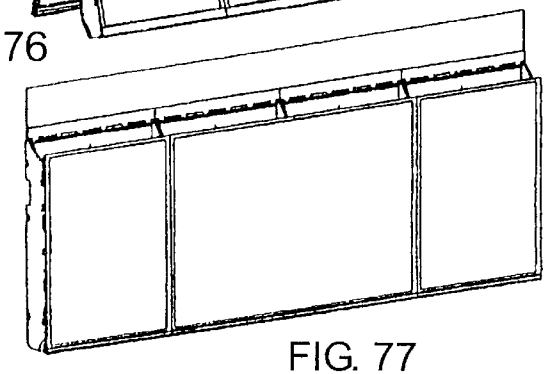

FIGS. 75 to 77 show four units joined side-to-side to perform as one display as wall mounted and step-forward (front and back) display units.

FIG. 75 is a front window and top front window view as a self standing counter top display.

FIG. 76 is a back and top window view as a self standing counter top display.

FIG. 77 is a front window and top front window view as a wall mounted display.

Figure 78:
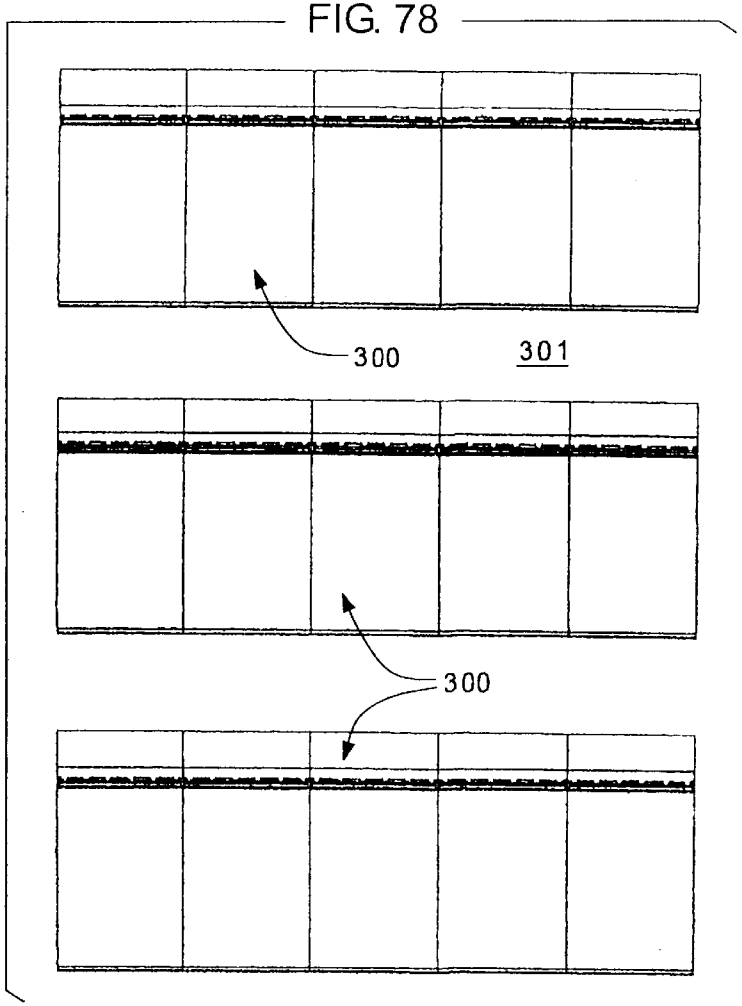
FIGS. 75 to 78: Show wall mounted and self standing units assembled together in possible embodiments.

FIG. 78 shows the potential effect of a mass display of three wall mounted displays 300 mounted one above the other on a wall 301.

Figures 79, 80, 81, 82:
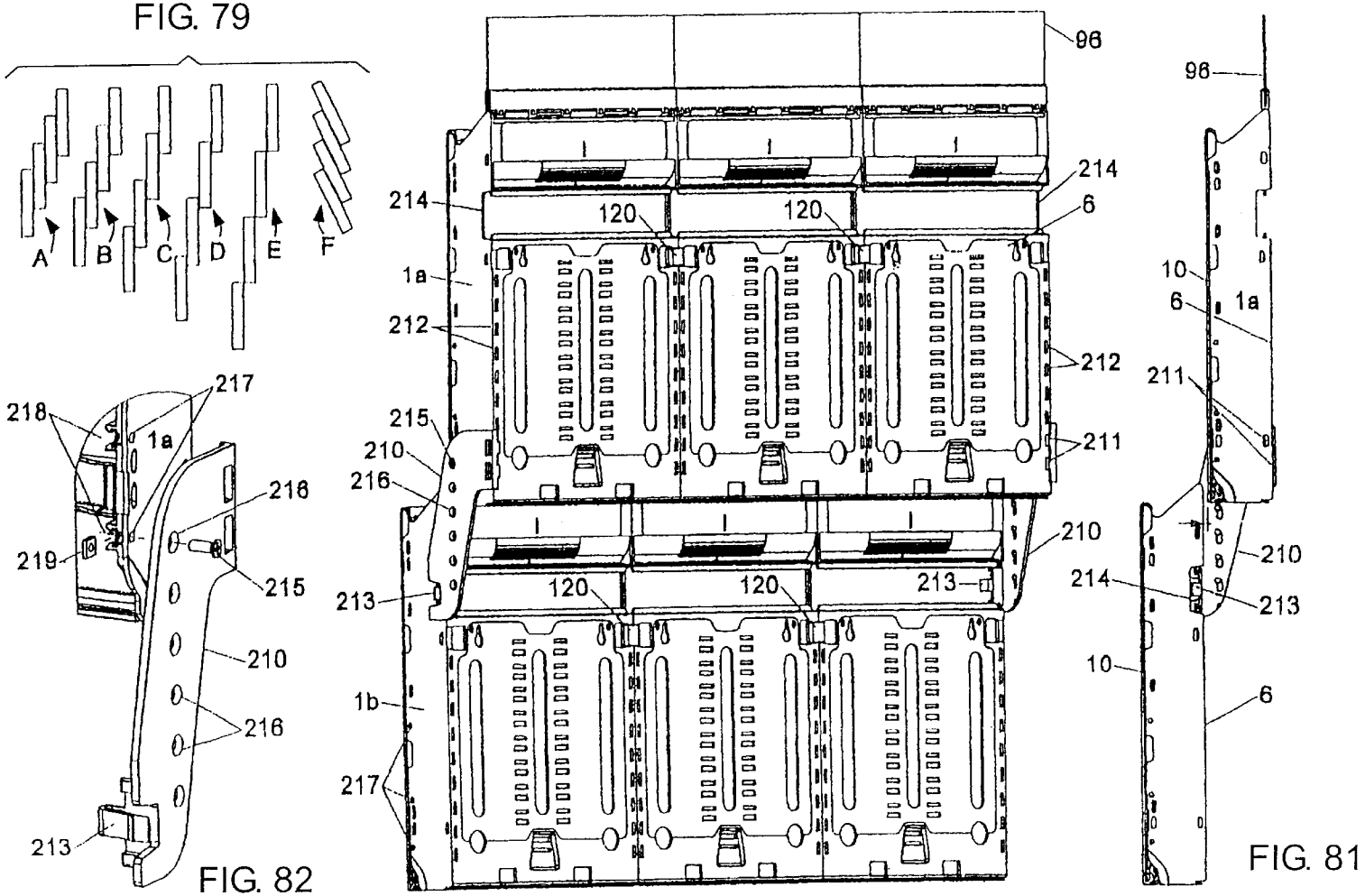
FIGS. 79 to 89: Show cascade assembly arrangements of possible embodiments.

FIG. 79 shows diagrams A, B, C, D, E & F, an end view of a self standing cascade of four rows, the rows shown progressively in various degrees of row overlap—concertina mode. Diagram F, shows a concertina cascade of four overlapping rows, as a hanging cascade.

Referring now to FIGS. 80 to 82, an embodiment provides a cascade bracket providing a new and useful way to utilize pamphlet display/dispensers.

Cascade brackets are used in conjunction with the row assembly clips FIGS. 70 to 74, and cascade struts 220 (see FIGS. 83 to 87), to assemble rows, then rows upon rows of pamphlet display/dispenser units into a multi-level (multi-row) cascading display.

The resulting modular cascading structure is extremely strong and does not require any other support, (other than the shelf, or the counter, the structure stands on). Such a strong assembled modular structure can be picked up and relocated as one whole assembly, it can be assembled on site or pre-assembled in the workshop for shipment to a remote location.

FIG. 80 shows—a back view of a two row cascade, rows 1*a* and 1*b*, row assembly clips 120, a left and a right cascade brackets 210, the brackets two fingered claw 211, the brackets two finger claw holes 212 in back wall 6, the built-in bracket clip 213, the built-in bracket clip receptor 214 and bracket screw 215, and screw holes 216 and 217.

The cascade bracket claws 211 are shown positioned in the lowest set of claw holes 212, but can be located alternatively in any of the claw holes 212. To concertina the upper rows of a cascade, the bracket claws 211 are inserted in any of the higher claw holes 212, up the left and right edge of back wall 6, to achieve the desired degree of row overlap. As the upper row drops behind the lower row, more screw holes 217, and threaded nuts 219, become available to secure the brackets and rows in place.

The cascade bracket claws, hook in to the claw hook holes at an angle, in the back of the top row unit 1*a*, then bringing the bracket around flush with the sides of the unit 1*a*, the claws tighten and lock into their holes. The brackets built-in clip 213 then clips into its clip receptor 214 in the lower unit 1*b*; the bracket and the unit 1*a* screw holes will now be aligned to accept the machine screw 215 so that it can engage with machine threaded nut 219 held in the nut pocket 218. The screw and nut are tightened to complete the clip together assembly at the right and left ends of each row pair.

FIG. 81 shows an end view of the two row cascade 1*a* and 1*b*, with the far (left) bracket 210 shown, and the near (right) bracket omitted to show better the bracket and row relationship in that view, showing also a small separation for example 4 mm between each row. When rows are in full overlap (concertina mode) the 4 mm gap ensures the front display window can still be opened to load or retrieve a front window displayed item. Also shown in that view, bracket claws 211 in back wall 6, bracket clip 213, bracket clip receptor 214, and front window 10.

FIG. 82 shows a view of the cascade bracket 210, the built-in bracket clip 213, the bracket screw 215, the bracket screw holes 216, and in the unit 1*a*, screw holes 217, threaded nut pocket 218 and threaded nut 219, and cascade built-in bracket clip 213 which when in use, locks into receptor 214, as seen in FIGS. 80 and 81.

Figure 85:
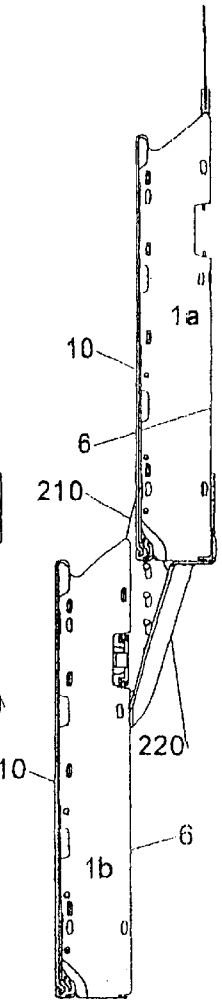
Figure 84:
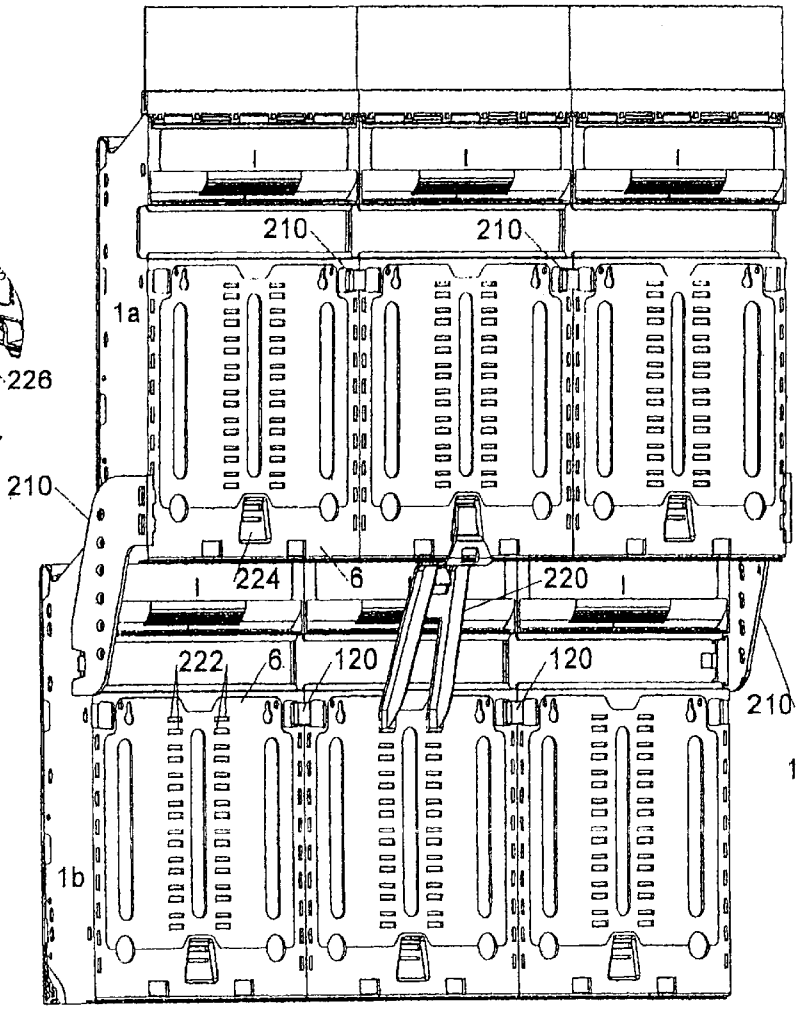
Figure 83:
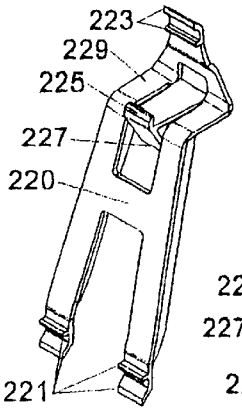

Referring to FIGS. 83 to 85, the cascade strut also provides a neat and simple connection means embodying elements of unique invention.

The cascade strut gives support to the cascade structure along the back of the cascade at suitable intervals connecting the upper and lower cascading unit rows 1*a* and 1*b*, 1*c* and 1*d* and so on depending on the number of rows in the structure.

FIG. 83 shows the cascade strut 220, the upper finger and thumb detail 223, the lower finger and thumb detail 221, the unit row seat 229, locking clip 225 and the unlocking trigger 227.

FIG. 84 shows a back view of a two row cascade, rows 1*a* and 1*b*, row assembly clips 120, a left and right cascade brackets 210, the cascade strut 220 installed in position, strut grip holes 224 and 222, in back wall 6 of units 1*a* and 1*b*.

FIG. 85 shows an end view of the two row cascade 1*a* and 1*b*, with the far (left) cascade bracket 210 shown, and the near (right) cascade bracket omitted to show better the cascade bracket, cascade strut and row relationship in that view. Also shown in that view, unit back wall 6 and the front window 10.

Figure 86:
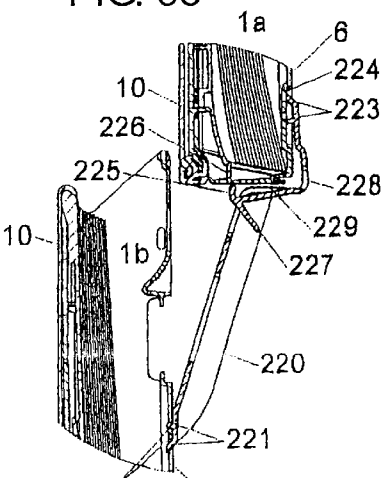

FIG. 86 shows a cut-away section view of the unique cascade strut in action. The lower strut finger and thumbs 221 are first engaged at an angle with their grip holes 222 of unit 1*b*, the strut is then brought into an upright position, there by completely locking the finger and thumb grip in all directions. As the strut was brought upright, the upper finger and thumbs 223 became aligned with their grip holes 224 of the units 1*a*. By now pressing the sprung push spot 228, several things will happen. As the push spot is pressed, the upper finger and thumbs 223 enter their grip holes 224 and lock firm, as at the same time, the locking clip 225 has passed beneath unit 1*a* to enter its grip hole 226, simply the whole process is completed in a split moment, without tools or fasteners to find or to lose or leave behind. To remove the strut, the process is quicker still, with a finger pushing on the push spot 228, and a finger on the unlocking trigger 227, the whole strut disengages to be repositioned or stored as required.

Figure 87:
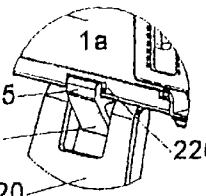

FIG. 87 shows a view of the cascade strut 220, the locking clip 225, engaged in its grip hole 226 in the front wall of unit 1*a*, and the unlocking trigger 227.

It is believed by the inventor that the unique "finger and thumb" locking connection is original and useful for broader categories of application, and, as designed for use, as described above, the strut finger and thumb locking action has exceeded all performance expectations.

Figure 89:
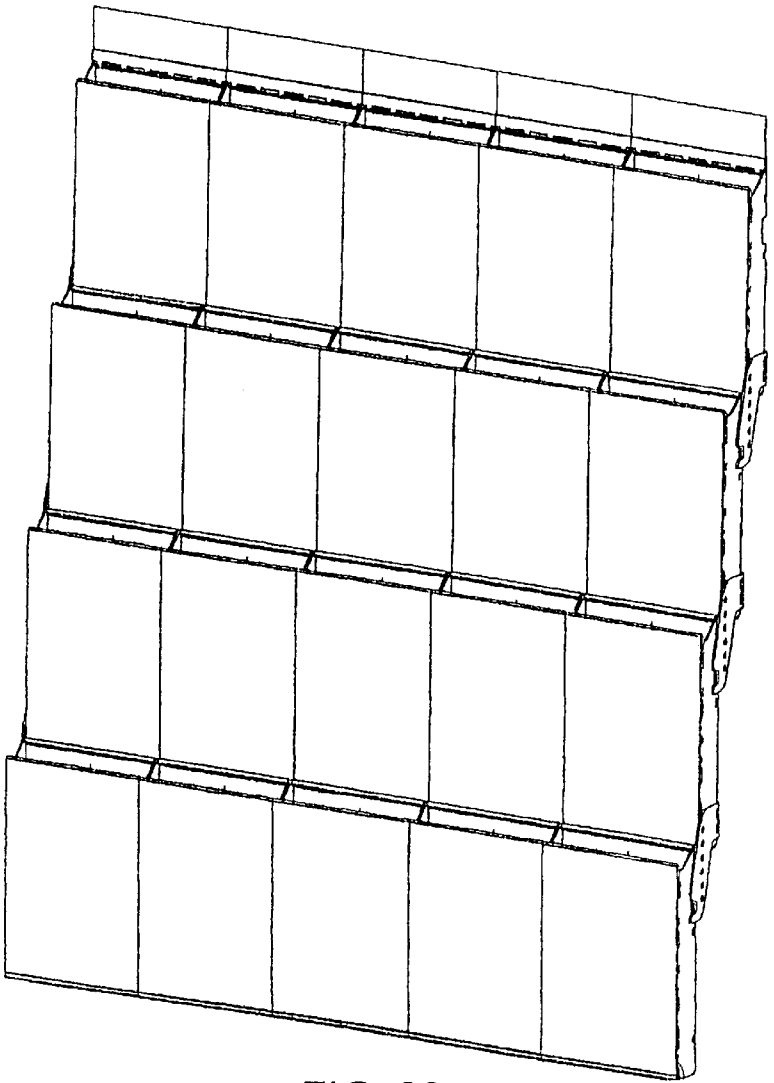
Figure 88:
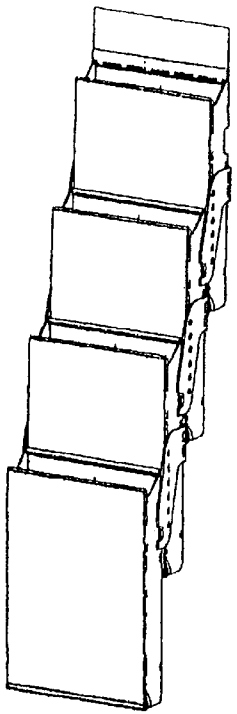

In FIGS. 88 and 89, cascade views of possible embodiments are shown.

FIG. 88 shows a cascade structure built to its maximum compression—50% front window exposure.

FIG. 89 shows a cascade structure built to its maximum extension—100% front window exposure.

There may, for example, be eight stations or exposure 50%, 57%, 64%, 71%, 78%, 85%, 92% and 100%.

Businesses that are pamphlet/brochure driven, for example a travel agency, wish to maximize pamphlet/brochure accommodation in a given space and alternatively maximize exposure and presentation impact of feature pamphlets related to any current promotion.

The cascade adjusted to its maximum compression, maximizes the number rows in a given height, thereby, maximizing the number of pamphlets that can be displayed in a given space.

The cascade, alternatively, adjusted to its maximum expansion, maximizes the pamphlet exposure to 100%.

The applicant considers that his invention in all its various aspects is unique in that no other modular pamphlet display/dispenser system can provide a large self supporting cascade, concertina to suit promotional and display objectives, the structural strength to be able to be self standing or be hung suspended fully loaded with pamphlets, or display and dispense a multiplicity of European and USA paper and pamphlet formats without pamphlet module sizes having to be changed. Display space management becomes so much easier, more flexible and substantially more attractive and orderly.

One single pamphlet display/dispenser, of this new design, has more new, unique and useful applications, functions and operational benefits, than any existing proposal. When each individual unit is collectively utilized as a pamphlet display/dispense system, those benefits are substantially magnified to represent a major contribution of features and benefits over any hitherto existing proposal known to the applicant.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

What is claimed is:

1. A pamphlet display/dispenser comprising:

a front wall spaced from a rear wall by a pair of side walls to define a cavity between said front wall, said rear wall and said pair of side walls, an open top defined by said cavity, a base interconnecting lower ends of the front and rear walls, and a front member provided separate from said front wall to contain and display a pamphlet in front of said front wall and adapted to pivot relative thereto, a top edge of the front member having a first hinge portion and an upper end of the front wall having a second hinge portion, said first and said hinge portions being inter-engageable to form a hinge enabling said front member to, pivot relative to said front wall to facilitate removal of a rearmost pamphlet from within said cavity and so that a lower portion of said front member can be spaced apart from a lower portion of said front wall to act as a support for the front, the rear wall, the pair of side walls and the base, said first hinge portion including a plurality of open faced hinge cups defining hinge axle cavities and extending along the top edge of said front member and said second hinge portion including hinge axles extending along the upper end of the front wall and engageable within said hinge axle cavities.

2. A pamphlet display/dispenser as claimed in claim 1, wherein vertically adjustable biasing means are provided so as to bias pamphlets contained within the cavity towards said front wall and further facilitate the removal of the rear most pamphlet.

3. A pamphlet display/dispenser as claimed in claim 2, wherein said biasing means includes depth adjustment clips movable vertically within the cavity to enable different sized pamphlets to be accommodated in the cavity.

4. A pamphlet display/dispenser as claimed in claim 1, wherein said front member is adapted to contain and display a pamphlet or other material.

5. A pamphlet display/dispenser as claimed in claim 1, wherein a bottom edge of said base includes surface engagement means.

6. A pamphlet display/dispenser as claimed in claim 1, including an upper display member provided for an upper edge of said rear wall.

7. A pamphlet display/dispenser as claimed in claim 6, wherein said upper display member is pivotable relative to said rear wall.

8. A pamphlet display/dispenser as claimed in claim 6, wherein said upper display member is adapted to receive a pamphlet or other display material.

9. A pamphlet display/dispenser as claimed in claim 6, wherein said upper display member is adapted to receive a pamphlet or other display material.

10. A pamphlet display/dispenser as claimed in claim 1, wherein the rear of said rear wall is adapted to receive and display a pamphlet or other display material.

11. A pamphlet display/dispenser as claimed in claim 1, adapted to be engageable laterally and/or vertically with another said pamphlet display/dispenser in providing a row or cascade of a plurality of said pamphlet display/dispensers.

12. A pamphlet display/dispenser as claimed in claim 11, wherein a said cascade or said row of said pamphlet display/dispensers enables a pamphlet or other material displayed at a front and/or rear surface to be extended across front or rear surfaces of said plurality of pamphlet display/dispensers.

13. A pamphlet display/dispenser as claimed in claim 11, wherein clipping means are adapted to be securable along adjoining edges of said plurality of pamphlet display/dispensers in connecting them together in said rows or in cascade.

14. A pamphlet display/dispenser as claimed in claim 11, wherein an elongate hook member is adapted to be engageable between adjacent sides of respective pamphlet display/dispensers in holding a plurality of said pamphlet display/dispensers in a chain cascade arrangement.

15. A pamphlet display/dispenser as claimed in claim 1, including in a rear surface of said rear wall, a channel adapted to receive a mounting means to hold said pamphlet display/dispenser in a required position.

16. A pamphlet display/dispenser as claimed in claim 15, wherein said mounting means includes, at least on one side thereof, a strip of a surface attachment means.

17. A pamphlet display/dispenser as claimed in claim 16, wherein said strip of said surface attachment means is provided on one said surface of said mounting means and wherein said mounting means is reversible to provide an alternative engagement means on its reversed side.

18. A pamphlet display/dispenser as claimed in claim 1, wherein a rear surface thereof is adapted to be provided with a magnetic support means to hold said pamphlet display/dispenser in position on a metallic surface.

19. A pamphlet display/dispenser as claimed in claim 1 including display means visible when said cavity or a portion of same is empty of pamphlets.

20. A pamphlet display/dispenser as claimed in claim 1, wherein one or more dividing means is adapted to be positionable within said cavity so that a plurality of pamphlets can be accommodated there within.

21. A pamphlet display/dispenser having a front wall spaced from a rear wall by a pair of side walls to define a cavity to contain pamphlets, an open top, a base interconnecting lower ends of the front and rear walls, a front member to contain and display a further pamphlet in front of said front wall and adapted to pivot relative thereto, a hinge connecting respective top edges of the front member and the front wall, the hinge including a plurality of open faced hinge cups along the top edge of the front member defining hinge axle cavities engaged with respective hinge axles along the top edge of the front wall, the hinge enabling the front member to pivot away from the front wall into a position spaced apart therefrom to support the pamphlet display/dispenser on a supporting surface and to facilitate the removal of a rearmost pamphlet from the cavity.

22. A pamphlet display/dispenser as claimed in claim 21, wherein the front member has a curved profile along its top edge which combines with the hinge cup to provide a smooth transitional radius for the top edge of the hinge when the front member and front wall are positioned against one another.

23. A pamphlet display/dispenser as claimed in claim 22, wherein the hinge includes a friction plate which enables the front member to be held at a required angle relative to the front wall.

* * * * *